US011733619B2

(12) United States Patent
Suzuki et al.

(10) Patent No.: US 11,733,619 B2
(45) Date of Patent: Aug. 22, 2023

(54) PRINTED MATTER, INFRARED-ABSORBING-PIGMENT-CONTAINING TONER, TONNER SET, IMAGE FORMING METHOD, AND IMAGE FORMING APPARATUS

(71) Applicant: RICOH COMPANY, LTD., Tokyo (JP)

(72) Inventors: Kazumi Suzuki, Shizuoka (JP); Masaki Yoshino, Kanagawa (JP); Nekka Matsuura, Kanagawa (JP); Toyoshi Sawada, Shizuoka (JP); Akihiro Kaneko, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 178 days.

(21) Appl. No.: 17/296,123

(22) PCT Filed: Nov. 27, 2019

(86) PCT No.: PCT/JP2019/046335
§ 371 (c)(1),
(2) Date: May 21, 2021

(87) PCT Pub. No.: WO2020/111108
PCT Pub. Date: Jun. 4, 2020

(65) Prior Publication Data

US 2021/0341851 A1 Nov. 4, 2021

(30) Foreign Application Priority Data

Nov. 29, 2018 (JP) ..... 2018-223010

(51) Int. Cl.
*G03G 9/09* (2006.01)
*G03G 9/087* (2006.01)
(Continued)

(52) U.S. Cl.
CPC ..... *G03G 9/0918* (2013.01); *G03G 9/08755* (2013.01); *G03G 9/08782* (2013.01);
(Continued)

(58) Field of Classification Search
CPC ... G03G 9/0906; G03G 9/0918; G03G 9/0926
See application file for complete search history.

(56) References Cited

U.S. PATENT DOCUMENTS

2003/0134214 A1 7/2003 Nakamura et al.
2010/0203437 A1* 8/2010 Yanagida ..... G03G 9/0914 430/105
(Continued)

FOREIGN PATENT DOCUMENTS

JP 2001-265181 A 9/2001
JP 2003-186238 A 7/2003
(Continued)

OTHER PUBLICATIONS

Translation of JP 2018-060169.*
(Continued)

*Primary Examiner* — Peter L Vajda
(74) *Attorney, Agent, or Firm* — Grüneberg and Myers PLLC

(57) ABSTRACT

Printed matter is provided which includes a recording medium, a colored layer overlying the recording medium, and an infrared-absorbing-pigment-containing layer overlying the recording medium and underlying the colored layer. The colored layer contains a colorant. The infrared-absorbing-pigment-containing layer contains an infrared absorbing pigment having an average diameter of from 120 to 250 nm in the infrared-absorbing-pigment-containing layer.

15 Claims, 15 Drawing Sheets

(51) Int. Cl.
*G03G 15/01* (2006.01)
*G03G 15/08* (2006.01)

(52) U.S. Cl.
CPC ..... *G03G 9/091* (2013.01); *G03G 9/0904* (2013.01); *G03G 9/0926* (2013.01); *G03G 15/0121* (2013.01); *G03G 15/0822* (2013.01)

(56) References Cited

U.S. PATENT DOCUMENTS

| | | | |
|---|---|---|---|
| 2015/0072287 | A1 | 3/2015 | Amemori et al. |
| 2015/0212442 | A1 | 7/2015 | Ishii et al. |
| 2015/0248074 | A1 | 9/2015 | Suzuki et al. |
| 2015/0253685 | A1 | 9/2015 | Suzuki et al. |
| 2015/0253688 | A1 | 9/2015 | Yamauchi et al. |
| 2016/0223926 | A1 | 8/2016 | Miyaake et al. |
| 2016/0327884 | A1 | 11/2016 | Nakajima et al. |
| 2017/0139337 | A1 | 5/2017 | Kaneko et al. |
| 2018/0067409 | A1 | 3/2018 | Yamauchi et al. |
| 2018/0113391 | A1 | 4/2018 | Yamauchi et al. |
| 2018/0259864 | A1 | 9/2018 | Suzuki et al. |
| 2018/0267418 | A1 | 9/2018 | Ogino et al. |
| 2019/0086834 | A1 | 3/2019 | Suzuki et al. |
| 2019/0196349 | A1 | 6/2019 | Sawada et al. |
| 2019/0196362 | A1 | 6/2019 | Tanaka et al. |
| 2019/0204760 | A1 | 7/2019 | Suzuki et al. |
| 2019/0278191 | A1 | 9/2019 | Suzuki et al. |
| 2020/0033745 | A1 | 1/2020 | Sawada et al. |

FOREIGN PATENT DOCUMENTS

| | | | | |
|---|---|---|---|---|
| JP | 2003-186246 | | 7/2003 | |
| JP | 2005-103980 | | 4/2005 | |
| JP | 2006-78888 | | 3/2006 | |
| JP | 2007-003942 | A | 1/2007 | |
| JP | 2007-003944 | A | 1/2007 | |
| JP | 2007-033681 | A | 2/2007 | |
| JP | 2007-171508 | A | 7/2007 | |
| JP | 2008-224712 | A | 9/2008 | |
| JP | 2009-091517 | A | 4/2009 | |
| JP | 2009-108324 | A | 5/2009 | |
| JP | 2009-209297 | A | 9/2009 | |
| JP | 2010-006999 | A | 1/2010 | |
| JP | 2010-106153 | A | 5/2010 | |
| JP | 2010-113368 | A | 5/2010 | |
| JP | 2010-184975 | A | 8/2010 | |
| JP | 2010-184980 | A | 8/2010 | |
| JP | 2010-186014 | | 8/2010 | |
| JP | 2013-158933 | A | 8/2013 | |
| JP | 2014-058054 | A | 4/2014 | |
| JP | 2016-045418 | | 4/2016 | |
| JP | 2017-102343 | | 6/2017 | |
| JP | 2018-053135 | A | 4/2018 | |
| JP | 2018-060169 | * | 4/2018 | ..... G03G 9/09 |
| JP | 2018-60169 | A | 4/2018 | |
| JP | 2019-001983 | A | 1/2019 | |
| WO | WO 2018/062052 | A1 | 4/2018 | |

OTHER PUBLICATIONS

International Search Report and Written Opinion dated Feb. 14, 2020 in PCT/JP2019/046335 filed on Nov. 27, 2019.
Japanese Office action dated Jul. 12, 2022, in Japanese Application No. 2018-223010, with English translation, 13 pages.
Japanese Office Action dated Apr. 4, 2023, in Japanese Application No. 2018-223010, 7 pages.

* cited by examiner

PRINTED MATTER, INFRARED-ABSORBING-PIGMENT-CONTAINING TONER, TONNER SET, IMAGE FORMING METHOD, AND IMAGE FORMING APPARATUS

TECHNICAL FIELD

The present disclosure relates to printed matter, an infrared-absorbing-pigment-containing toner, a toner set, an image forming method, and an image forming apparatus.

BACKGROUND ART

Various additional data embedding techniques for embedding additional information in an image by superimposition have been proposed.

In recent years, additional data embedding techniques have been actively used for copyright protection (e.g., illegal copy protection) of digital works such as still images. As an example, for the case in which a digital work is printed on a recording medium by an image forming apparatus, a technique for embedding information as to the image forming apparatus is known. This technique involves forming an invisible pattern (i.e., an image difficult to visually recognize) on the recording medium together with the digital work.

For reading such an invisible pattern, infrared absorption has been utilized. One proposed technique involves recording an image with a normal color toner and another image with an infrared-absorbing-pigment-containing toner (hereinafter may be referred to as "invisible toner") having low visible light absorption in parallel or in layers such that the two images are substantially unidentifiable or indistinguishable by the naked eye (see, for example, Patent Document 1).

Another proposed technique involves forming an invisible toner image and a color toner image such that the gloss value of the invisible toner image is lower than that of the color toner image, so as not to impair the image quality of the color toner image provided in the same area as the invisible toner image on a recording medium when the color toner image is visually observed, to make it possible to record information in the invisible toner image at a high density, and to perform machine reading and decoding by infrared irradiation over an extended period of time (see, for example, Patent Documents 2 to 4).

Another proposed technique involves providing an invisible toner layer as the lowermost layer on one side of a recording medium and providing a color toner layer on the invisible toner layer, with the gloss value of the invisible toner being higher than that of the color toner, so as to ensure sufficient spreadability of the invisible toner at the time of fixing to achieve more reliable machine readability without loss of the invisible toner layer (see, for example, Patent Document 5).

Further, squarylium dyes having a specific structure are known as infrared absorbing pigments having high transparency and invisibility (see, for example, Patent Documents 6 to 10).

CITATION LIST

Patent Literature

PTL 1: Japanese Unexamined Patent Application Publication No. 2001-265181

PTL 2: Japanese Unexamined Patent Application Publication No. 2007-171508
PTL 3: Japanese Unexamined Patent Application Publication No. 2007-3944
PTL 4: Japanese Unexamined Patent Application Publication No. 2010-113368
PTL 5: Japanese Unexamined Patent Application Publication No. 2018-060169
PTL 6: Japanese Unexamined Patent Application Publication No. 2009-91517
PTL 7: Japanese Unexamined Patent Application Publication No. 2010-106153
PTL 8: Japanese Unexamined Patent Application Publication No. 2010-184975
PTL 9: Japanese Unexamined Patent Application Publication No. 2010-184980
PTL 10: Japanese Unexamined Patent Application Publication No. 2009-209297
PTL 11: Japanese Patent No. 6322837

SUMMARY OF INVENTION

Technical Problem

An object of the present invention is to provide printed matter having an infrared-absorbing-pigment-containing layer containing a reduced amount of an infrared absorbing pigment, that provides reliable machine readability while ensuring invisibility of the layer.

Solution to Problem

To solve the above-described problem, some embodiments of the present invention provide printed matter comprising a recording medium, a colored layer overlying the recording medium, and an infrared-absorbing-pigment-containing layer overlying the recording medium and underlying the colored layer. The colored layer contains a colorant. The infrared-absorbing-pigment-containing layer contains an infrared absorbing pigment having an average diameter of from 120 to 250 nm in the infrared-absorbing-pigment-containing layer.

Advantageous Effects of Invention

According to some embodiments of the present invention, printed matter having an infrared-absorbing-pigment-containing layer containing a reduced amount of an infrared absorbing pigment is provided, that achieves reliable machine readability while ensuring invisibility of the layer.

BRIEF DESCRIPTION OF DRAWINGS

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF EMBODIMENTS

Figure 1:
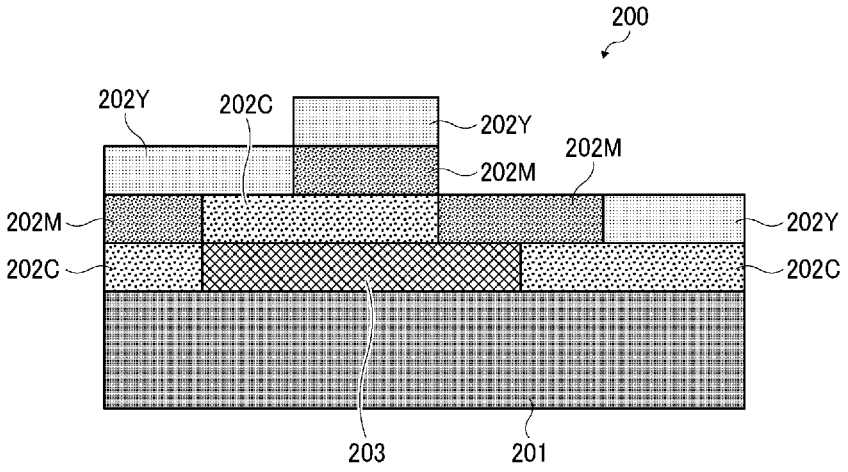
FIG. 1 is a schematic diagram illustrating printed matter according to an embodiment of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Within the context of the present disclosure, if a first layer is stated to be "overlaid" or "underlaid" on, or "overlying" or "underlying" a second layer, the first layer may be in direct contact with a portion or all of the second layer, or there may be one or more intervening layers between the first and second layer.

Printed Matter

The printed matter according to an embodiment of the present invention comprises a recording medium, a colored layer overlying the recording medium, and an infrared-absorbing-pigment-containing layer overlying the recording medium and underlying the colored layer. The colored layer contains a colorant. The infrared-absorbing-pigment-containing layer contains an infrared absorbing pigment having an average diameter of from 120 to 250 nm in the infrared-absorbing-pigment-containing layer. The printed matter further includes other layers, as necessary.

In any conventional technique, the invisible toner layer contains a sufficient amount of an infrared absorbing pigment for machine reading. This is because machine readability is unstable unless absorption at any infrared reading wavelength is sufficient. On the other hand, the infrared absorbing pigment has a slight color saturation while being invisible. Therefore, when the content of the infrared absorbing pigment increases, the invisibility is impaired, which is undesirable.

The printed matter according to an embodiment of the present invention comprises a recording medium, a colored layer overlying the recording medium, and an infrared-absorbing-pigment-containing layer overlying the recording medium and underlying the colored layer, where the colored layer contains a colorant and the infrared-absorbing-pigment-containing layer contains an infrared absorbing pigment. When the average diameter of the infrared absorbing pigment is from 120 to 250 nm, since the infrared absorbing pigment is read by infrared, the larger the average diameter thereof than that of the colorant on which visible light functions, the higher the reading accuracy, because the rate of the transmitted infrared decreases. Thus, the printed matter provides reliable machine readability and ensures invisibility of the infrared-absorbing-pigment-containing layer even when the amount of the infrared absorbing pigment is reduced.

Recording Medium

The recording medium is not particularly limited in shape, structure, size, etc., and can be appropriately selected to suit to a particular application. The shape may be, for example, a flat-plate-like shape. The structure may be, for example, a single-layer structure or a multi-layer structure. The size can be appropriately selected to suit to the size of the printed matter.

Examples of the material of the recording medium include, but are not limited to, inorganic materials and organic materials.

Examples of the inorganic materials include, but are not limited to, glass, quartz, silicon, silicon oxide, aluminum oxide, $SiO_2$, and metals.

Examples of the organic materials include, but are not limited to, paper, cellulose derivatives such as cellulose triacetate, synthetic paper, films of polyethylene terephthalate, polycarbonate, polystyrene, and polymethyl methacrylate.

Each of these inorganic and organic materials may be used alone or in combination with others. Among these materials, organic materials are preferable. Specifically, films of polyvinyl chloride resin, polyethylene, polypropylene, polyethylene terephthalate, polycarbonate, and polymethyl methacrylate are preferable, and polyethylene terephthalate is particularly preferred.

Preferably, the recording medium is surface-modified for the purpose of improving adhesiveness to coating layers. Examples of the surface modification include, but are not limited to, corona discharge treatment, oxidation reaction treatment (with chromic acid, etc.), etching treatment, easy adhesion treatment, and antistatic treatment.

The average thickness of the recording medium is not particularly limited and can be suitably selected to suit to a particular application, but is preferably from 10 to 2,000 μm, and more preferably from 50 to 1,000 μm.

Colored Layer

The colored layer is disposed overlying the recording medium. The colored layer contains a colorant and further contains other components, as necessary.

Colorant

The colorant is not particularly limited and can be suitably selected to suit to a particular application. Specific examples thereof include, but are not limited to, NAPHTHOL YELLOW S, HANSA YELLOW (10G, 5G, and G), polyazo yellow, Oil Yellow, HANSA YELLOW (GR, A, RN, and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, Permanent Red 4R, Para Red, Fire Red, pchloro-o-nitroaniline red, Lithol Fast Scarlet G, Brilliant Fast Scarlet, Brilliant Carmine BS, PERMANENT RED (F2R, F4R, FRL, FRLL, and F4RH), Fast Scarlet VD, Brilliant Scarlet G, Permanent Red F5R, Brilliant Carmine 6B, Pigment Scarlet 3B, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, dioxane violet, Anthraquinone Violet, Phthalocyanine Green, Anthraquinone Green, perylene black, perinone black, aniline black, and azo black. Each of these colorants can be used alone or in combination with others.

When used for a process color toner, the following black, cyan, magenta, and yellow colorants are preferred.

As black colorants, perylene black, perinone black, or aniline black is preferably used as a main black pigment.

As cyan colorants, C.I. Pigment Blue 15:3 is preferred.

As magenta colorants, C.I. Pigment Red 122, C.I. Pigment Red 269, and C.I. Pigment Red 81:4 are preferred.

As yellow colorants, C.I. Pigment Yellow 74, C.I. Pigment Yellow 155, C.I. Pigment Yellow 180, and C.I. Pigment Yellow 185 are preferred.

Each of these colorants can be used alone or in combination with others.

Perylene black that contains a compound having a perylene structure or perinone black that contains a compound having a perinone structure are preferably used as black colorants, because they have a high degree of coloring power and are capable of forming a black image that transmits infrared light without being affected by charging property of the toner.

The proportion of the colorant in the colored layer is preferably from 3% to 12% by mass, more preferably from 5% to 10% by mass, although it depends on the coloring power of each colorant. When the proportion is 3% by mass or more, an undesirable phenomenon is prevented in which the amount of deposition of each single-color toner is increased due to its insufficient coloring power, resulting in waste of resources. When the proportion is 12% by mass or less, an undesirable phenomenon is prevented in which chargeability of the toner is greatly affected to make it difficult to maintain the amount of toner charge.

The average diameter of the colorant in the colored layer is preferably 120 nm or less, more preferably 100 nm or less. When the average diameter of the colorant exceeds 120 nm, the coloring power of the colored layer may decrease and scattering components of light with the transmissive wavelength may increase to increase the haze.

Preferably, the colorant comprises a yellow colorant, a magenta colorant, and a cyan colorant, and the absorbance of the colorant at a wavelength of from 750 to 900 nm is 0.01 or less.

When the absorbance of the colorant at a wavelength of from 750 to 900 nm is 0.01 or less, an undesirable phenomenon is prevented in which reading of information formed with the infrared-absorbing-pigment-containing layer is inhibited by the colored layer which is superimposed on the infrared-absorbing-pigment-containing layer.

Preferably, the colorant comprises a yellow colorant, a magenta colorant, a cyan colorant, and a black colorant, and the absorbance of the colorant at a wavelength of from 750 to 900 nm is 0.01 or less.

When the absorbance of the colorant at a wavelength of from 750 to 900 nm is 0.01 or less, an undesirable phenomenon is prevented in which reading of information formed with the infrared-absorbing-pigment-containing layer is inhibited by the colored layer which is superimposed on the infrared-absorbing-pigment-containing layer.

Other Components

The other components are not particularly limited and may be appropriately selected depending on the material used for forming the colored layer. For example, when the colored layer is formed by an electrophotographic method, components of the color toner may be included in the colored layer. The components of the color toner other than the colorant are described later in describing the color toner included in the toner set.

The method for forming the colored layer is not particularly limited and can be suitably selected to suit to a particular application. Examples thereof include, but are not limited to, plate printing such as offset printing and screen printing, and plateless printing such as electrophotographic methods, inkjet methods, and thermal transfer methods. Among these methods for forming the colored layer, electrophotographic methods are preferred. The colored layer which is formed by an electrophotographic method is less likely to bleed as compared with that formed by an inkjet method. Thus, readability of the infrared-absorbing-pigment-containing layer is ensured. Further, electrophotographic methods have an advantage that no remaining film (waste) is generated unlike thermal transfer methods.

Infrared-Absorbing-Pigment-Containing Layer

The infrared-absorbing-pigment-containing layer is disposed overlying the recording medium and underlying the colored layer. The infrared-absorbing-pigment-containing layer contains an infrared absorbing pigment and further contains other components, as necessary. Preferably, the infrared-absorbing-pigment-containing layer is disposed as the lower layer on a side of the recording medium which has the colored layer, i.e., as the layer nearest of the recording medium.

The infrared-absorbing-pigment-containing layer is a layer that is substantially indistinguishable or difficult to distinguish with the naked eye.

Infrared Absorbing Pigment

The infrared absorbing pigment has invisibility. Examples thereof include, but are not limited to, aluminum salt compounds, naphthalocyanine compounds, and squarylium compounds.

Among these infrared absorbing pigments, naphthalocyanine compounds and squarylium compounds are preferred, and naphthalocyanine compounds are more preferred because they have a low absorbance in the visible light region, excellent weather resistance, and little influence on toner charging.

The naphthalocyanine compounds are not particularly limited and can be suitably selected to suit to a particular application, but the compound represented by the following formula (1) is preferred.

[Chem.1]

Formula (1)

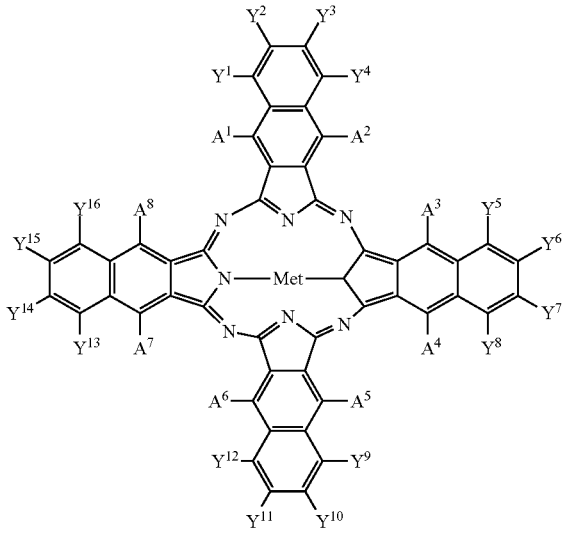

In the formula (1), Met represents two hydrogen atoms, a divalent metal atom, or a trivalent or tetravalent substituted metal atom; each of $A^1$ to $A^8$ independently represents a hydrogen atom, a halogen atom, a substituted or unsubstituted alkyl group, a substituted or unsubstituted aryl group, a substituted or unsubstituted alkoxy group, a substituted or unsubstituted aryloxy group, a substituted or unsubstituted alkylthio group, or a substituted or unsubstituted arylthio group, where, in each of combinations of $A^1$ and $A^2$, $A^3$ and $A^4$, $A^5$ and $A^6$, and $A^7$ and $A^8$, both elements do not simultaneously represent a hydrogen atom or a halogen atom; and each of $Y^1$ to $Y^{16}$ independently represents a hydrogen atom, a halogen atom, a substituted or unsubstituted alkyl group, a substituted or unsubstituted aryl group, a substituted or unsubstituted alkoxy group, a substituted or unsubstituted aryloxy group, a substituted or unsubstituted alkylthio group, a substituted or unsubstituted arylthio group, a substituted or unsubstituted alkylamino group, a substituted or unsubstituted dialkylamino group, a substituted or unsubstituted arylamino group, a substituted or unsubstituted diarylamino group, a substituted or unsubstituted alkylarylamino group, a hydroxy group, a mercapto group, a nitro group, a nitrile group, an oxycarbonyl group, an alkoxycarbonyl group, an aryloxycarbonyl group, an aminocarbonyl group, or a mono- or di-substituted aminocarbonyl group.

Among the compounds represented by the above formula (1), vanadium naphthalocyanine represented by the following structural formula (1) is preferred because it has a low absorbance in the visible light region, excellent weather resistance, and little influence on toner charging.

[Chem. 2]

Structural Formula (1)

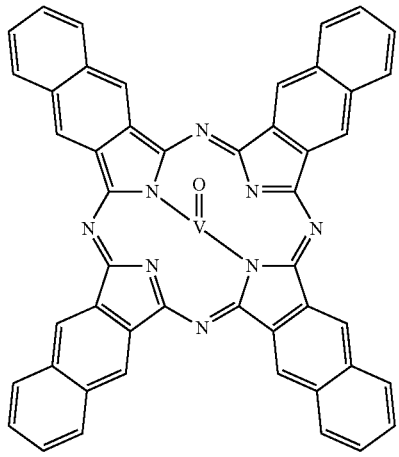

As examples of the squarylium compounds, perimidine-type squarylium dyes are known (see, for example, JP-2009-91517-A, JP-2010-106153-A, JP-2010-184975-A, and JP-2010-184980-A). Squarylium compounds described in JP-2009-209297-A and JP-6322837-B are insufficient in light resistance when present as dyes in the molecule state. However, when they are present as pigments in the crystalline state, light resistance is in the practical level.

In any case, an infrared absorbing pigment having no visible light absorption does not exist. Therefore, the content of the infrared absorbing pigment is preferably small for maintaining invisibility and from an economical point of view.

Preferably, the proportion of the infrared absorbing pigment in the infrared-absorbing-pigment-containing layer is from 0.3% to 1.0% by mass.

Even when the proportion of the infrared absorbing pigment is that small, i.e., from 0.3% to 1.0% by mass, sufficient invisibility is provided, which is advantageous.

The proportion of the infrared absorbing pigment varies depending on the properties of the material. However, if the proportion of the infrared absorbing pigment is not sufficient and the absorption of near infrared light is not sufficient, the thickness of the infrared-absorbing-pigment-containing layer is increased to generate visible unevenness and to waste resources. By contrast, if the proportion of the infrared absorbing pigment is excessive, the infrared-absorbing-pigment-containing layer becomes easily visible due to its slight absorption in the visible light wavelength region.

Preferably, the infrared absorbing pigment is dispersed in the infrared-absorbing-pigment-containing layer. If the infrared absorbing pigment is unevenly distributed in the infrared-absorbing-pigment-containing layer, information cannot be read accurately and stably.

When the infrared absorbing pigment is uniformly dispersed in the infrared-absorbing-pigment-containing layer formed on the recording medium, the infrared-absorbing-pigment-containing layer exhibits sufficient absorption in the infrared region without impairing invisibility in the visible region and is capable of recording with a high density. Thus, mechanical reading and decoding processing of the infrared-absorbing-pigment-containing layer can be reliably performed over an extended period of time.

The average diameter of the infrared absorbing pigment in the infrared-absorbing-pigment-containing layer is from 120 to 250 nm.

When the average diameter of the infrared absorbing pigment is 120 nm or more, an appropriate amount of infrared light is transmitted without being absorbed, and machine readability is good. In addition, light resistance decreases. When the average diameter of the infrared absorbing pigment is 250 nm or less, both visible light absorption and infrared absorption are good.

The average diameter of the infrared absorbing pigment can be adjusted by selection of the primary particle diameter of the pigment and by processing means in mixing the pigment with other materials forming the infrared-absorbing-pigment-containing layer.

For example, in offset printing, kneading strength in the kneading process in producing an offset ink is adjusted. In an electrophotographic method, master batch kneading conditions and toner kneading conditions in producing a toner is adjusted. In an inkjet method, pigment dispersion process conditions in manufacturing an ink is adjusted.

Measurement of Average Diameter of Colorant and Infrared Absorbing Pigment

The average diameters of the colorant and the infrared absorbing pigment contained in the colored layer and the infrared-absorbing-pigment-containing layer, respectively, can be measured as follows.

Printed matter in which the colored layer and the infrared-absorbing-pigment-containing layer are laminated is cut, in the vertical direction, into a thin piece having a thickness of 100 μm or less with a razor blade. The cut piece is embedded in an epoxy resin and then cut into an ultrathin section having a thickness of about 100 nm with an ultramicrotome ULTRACUT-S (manufactured by Leica). The ultrathin section is observed with a transmission electron microscope H7000 (manufactured by Hitachi, Ltd.), and a cross-sectional image of the colored layer and the infrared-absorbing-pigment-containing layer is digitally photographed at a magnification of 10,000 times. The cross-sectional image is analyzed with an image analysis software (e.g., A-ZOU KUN manufactured by Asahi Kasei Engineering Corporation) to distinguish each of the colorant and the infrared absorbing pigment from other components by binarization, and each area is calculated. As a result, the average diameter of each of the colorant and the infrared absorbing pigment in the colored layer and the infrared-absorbing-pigment-containing layer, respectively, can be determined.

With respect to an agglomerate of the colorant or the infrared absorbing pigment contained in the colored layer or the infrared-absorbing-pigment-containing layer, respectively, not the primary particle thereof but the agglomerate itself is treated as one particle unit in calculating the particle diameter.

The average diameter of the colorant and the infrared absorbing pigment contained in a master batch may be measured in the same manner as that of the colorant and the infrared absorbing pigment contained in the colored layer and the infrared-absorbing-pigment-containing layer, respectively, except that the master batch is pulverized to have a particle diameter of 100 μm or less and the pulverized product is embedded in an epoxy resin and cut into an ultra-thin section having a thickness of about 100 nm with an ultramicrotome ULTRACUT-S (manufactured by Leica).

The average diameter of the colorant and the infrared absorbing pigment contained in a toner may be measured in the same manner as that of the colorant and the infrared absorbing pigment contained in the colored layer and the infrared-absorbing-pigment-containing layer, respectively, except that the toner is embedded in an epoxy resin and cut into an ultra-thin section having a thickness of about 100 nm with an ultramicrotome ULTRACUT-S (manufactured by Leica).

The reflectance of the infrared absorbing pigment at a reading wavelength is preferably 50% or less, more preferably 40% or less, for reliable machine reading upon infrared light irradiation. When the reflectance is 50% or less, reading can be reliably performed upon infrared light irradiation.

The reflectance may be measured from the output solid image using a spectrophotometer (e.g., V-660 manufactured by JASCO Corporation, eXact manufactured by X-Rite Inc.).

Other Components

The other components are not particularly limited and may be appropriately selected depending on the material used for forming the infrared-absorbing-pigment-containing layer. For example, when the infrared-absorbing-pigment-containing layer is formed by an electrophotographic method, components of an infrared-absorbing-pigment-containing toner may be included in the infrared-absorbing-pigment-containing layer. The components of the infrared-absorbing-pigment-containing toner other than the infrared absorbing pigment are described later in describing the infrared-absorbing-pigment-containing toner included in the toner set.

The method for forming the infrared-absorbing-pigment-containing layer is not particularly limited and can be suitably selected to suit to a particular application. Examples thereof include, but are not limited to, plate printing such as offset printing and screen printing, and plateless printing such as electrophotographic methods, inkjet methods, and thermal transfer methods. In particular, it is preferable that the infrared-absorbing-pigment-containing layer containing the infrared absorbing pigment that requires information variability is a variable printing layer formed by plateless printing.

Among these methods for forming the infrared-absorbing-pigment-containing layer, electrophotographic methods are particularly preferred. The infrared-absorbing-pigment-containing layer which is formed by an electrophotographic method is less likely to bleed when formed as the lower layer on the recording medium as compared with that formed by an inkjet method. Thus, readability of the infrared-absorbing-pigment-containing layer is ensured. Further, electrophotographic methods have an advantage that no remaining film (waste) is generated unlike thermal transfer methods.

FIG. 1 is a schematic diagram illustrating printed matter according to an embodiment of the present invention. Referring to FIG. 1, printed matter 200 includes a recording medium 201, and an infrared-absorbing-pigment-containing layer 203 containing an infrared absorbing pigment, a colored layer 202C containing a cyan colorant, a colored layer 202M containing a magenta colorant, and a colored layer 202Y containing a yellow colorant, each overlying the recording medium 201.

The infrared-absorbing-pigment-containing layer 203 is disposed as the lower layer on a side of the recording medium 201 which has the colored layers thereon, i.e., as the layer nearest of the recording medium. Therefore, the infrared-absorbing-pigment-containing layer is reliably readable by machine and invisibility of the infrared absorbing layer is ensured.

Infrared-Absorbing-Pigment-Containing Toner

The infrared-absorbing-pigment-containing toner according to an embodiment of the present invention contains a binder resin and an infrared absorbing pigment.

The average diameter of the infrared absorbing pigment in the toner is from 120 to 250 nm.

The infrared-absorbing-pigment-containing toner according to an embodiment of the present invention is a toner having a very low degree of coloring. The toner has a high degree of invisibility but has a slight degree of coloring. When the degree of coloring is decreased, the absorption of infrared rays becomes small, and machine reading becomes difficult. When the degree of coloring is increased, invisibility decreases.

Toner Set

The toner set according to an embodiment of the present invention includes a color toner containing a binder resin and a colorant, and the infrared-absorbing-pigment-containing toner according to an embodiment of the present invention.

The toner set according to an embodiment of the present invention provides printed matter including both an infrared-absorbing-pigment-containing toner image and a color toner image on a recording medium, in which visibility of the color toner image and reading accuracy of the infrared-absorbing-pigment-containing toner image are excellent.

Preferably, the color toner includes at least one of yellow toner, magenta toner, cyan toner, and black toner.

Color Toner and Infrared-Absorbing-Pigment-Containing Toner

The color toner contains the above-described colorant. Preferably, the color toner further contains a binder resin. The color toner may further contain other components, as necessary.

The infrared-absorbing-pigment-containing toner contains the above-described infrared absorbing pigment. Preferably, the infrared-absorbing-pigment-containing toner further contains a binder resin. The infrared-absorbing-pigment-containing toner may further contain other components, as necessary.

Binder Resin

The binder resin is not particularly limited and can be suitably selected to suit to a particular application. Examples thereof include, but are not limited to, styrene-based resins such as styrene, α-methylstyrene, chlorostyrene, styrene-propylene copolymer, styrene-butadiene copolymer, styrene-vinyl chloride copolymer, styrene-vinyl acetate copolymer, styrene-maleic acid copolymer, styrene-acrylate copolymer, styrene-methacrylate copolymer, and styrene-acrylonitrile-acrylate copolymer, polyester resins, vinyl chloride resins, rosin-modified maleic acid resins, phenol resins, epoxy resins, polyethylene resins, polypropylene resins, ionomer resins, polyurethane resins, silicone resins, ketone resins, xylene resins, petroleum resins, and hydrogenated petroleum resins. Each of these binder resins can be used alone or in combination with others. Among these binder resins, styrene-based resins containing aromatic compounds as constitutional units and polyester resins are preferred, and polyester resins are more preferred.

The polyester resin is not particularly limited and may be obtained by a polycondensation reaction between an alcohol and an acid which are commonly known.

Specific examples of the alcohol include, but are not limited to: diols such as polyethylene glycol, diethylene glycol, triethylene glycol, 1,2-propylene glycol, 1,3-propylene glycol, 1,4-propylene glycol, neopentyl glycol, and 1,4-butenediol; etherified bisphenols such as 1,4-bis(hydroxymethyl)cyclohexane, bisphenol A, hydrogenated bisphenol A, polyoxyethylenated bisphenol A, and polyoxypropylenated bisphenol A; divalent alcohol monomers obtained by substituting the above compounds with a saturated or unsaturated hydrocarbon group having 3 to 22 carbon atoms; other divalent alcohol monomers; and trivalent or higher alcohol monomers such as sorbitol, 1,2,3,6-hexanetetraol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene. Each of these alcohols may be used alone or in combination with others.

The acid is not particularly limited and can be suitably selected to suit to a particular application, but a carboxylic acid is preferred.

Specific examples of the carboxylic acid include, but are not limited to: monocarboxylic acids such as palmitic acid, stearic acid, and oleic acid; maleic acid, fumaric acid, mesaconic acid, citraconic acid, terephthalic acid, cyclohexanedicarboxylic acid, succinic acid, adipic acid, sebacic acid, and malonic acid, and divalent organic acid monomers obtained by substituting these acids with a saturated or unsaturated hydrocarbon group having 3 to 22 carbon atoms; anhydrides of these acids; dimers of lower alkyl esters and linolenic acid; 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and enpol trimer acid; and trivalent or higher polyvalent carboxylic acid monomers such as anhydrides of the above acids. Each of these acids may be used alone or in combination with others.

The binder resin may contain a crystalline resin.

The crystalline resin is not particularly limited and can be suitably selected to suit to a particular application as long as it has crystallinity. Examples of the crystalline resin include, but are not limited to, polyester resins, polyurethane resins, polyurea resins, polyamide resins, polyether resins, vinyl resins, and modified crystalline resins. Each of these crystalline resins may be used alone or in combination with others. Among these crystalline resins, polyester resins, polyurethane resins, polyurea resins, polyamide resins, and polyether resins are preferred. In particular, crystalline resins having at least one of a urethane backbone and a urea backbone are preferred for imparting moisture resistance and incompatibility with an amorphous resin.

The crystalline resin preferably has a weight average molecular weight (Mw) of from 2,000 to 100,000, more preferably from 5,000 to 60,000, and most preferably from 8,000 to 30,000, for fixability. When the weight average molecular weight is 2,000 or more, deterioration of hot offset resistance can be prevented. When the weight average molecular weight is 100,000 or less, deterioration of low-temperature fixability can be prevented.

Other Components

The other components are not particularly limited and can be suitably selected to suit to a particular application as long as they are generally contained in toner. Examples thereof include, but are not limited to, a release agent, a charge controlling agent, and an external additive.

Release Agent

Examples of the release agent include, but are not limited to, natural waxes and synthetic waxes. Each of these release agents may be used alone or in combination with others.

Specific examples of the natural waxes include, but are not limited to: plant waxes such as carnauba wax, cotton wax, sumac wax, and rice wax; animal waxes such as beeswax and lanolin; mineral waxes such as ozokerite and ceresin; and petroleum waxes such as paraffin, microcrystalline, and petrolatum.

Specific examples of the synthetic waxes include, but are not limited to: synthetic hydrocarbon waxes such as Fischer-Tropsch wax and polyethylene wax; synthetic waxes such as esters, ketones, and ethers; fatty acid amides such as 1,2-hydroxystearic acid amide, stearic acid amide, phthalic anhydride imide, and chlorinated hydrocarbons; and low-molecular-weight crystalline polymers, such as homopolymers and copolymers of polyacrylates such as n-stearyl polymethacrylate and n-lauryl polymethacrylate (e.g., n-stearyl acrylate-ethyl methacrylate copolymer), which have a long-chain alkyl group on a side chain.

Preferably, the release agent comprises a monoester wax. Since the monoester wax has low compatibility with general binder resins, the monoester wax easily exudes out to the surface of the toner when the toner is fixed. Thus, the toner exhibits high releasability while securing high gloss and sufficient low-temperature fixability.

Preferably, the monoester wax is of a synthetic ester wax. Examples of the synthetic ester wax include, but are not limited to, a monoester wax synthesized from a long-chain linear saturated fatty acid and a long-chain linear saturated alcohol. The long-chain linear saturated fatty acid is represented by the general formula $C_nH_{2n+1}COOH$, and one having n of about 5 to 28 is preferred. The long-chain linear saturated alcohol is represented by the general formula $C_nH_{2n+1}OH$, and one having n of about 5 to 28 is preferred.

Specific examples of the long-chain linear saturated fatty acid include, but are not limited to, capric acid, undecylic acid, lauric acid, tridecylic acid, myristic acid, pentadecylic acid, palmitic acid, heptadecanoic acid, tetradecanoic acid, stearic acid, nonadecanoic acid, behenic acid, lignoceric acid, cerotic acid, heptacosanoic acid, montanic acid, and melissic acid. Specific examples of the long-chain linear saturated alcohol include, but are not limited to, amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol. The long-chain linear saturated fatty acid and the long-chain linear saturated alcohol may have a substituent such as a lower alkyl group, an amino group, and a halogen.

Preferably, the release agent has a melting point of from 50 to 120 degrees C. When the melting point of the release agent is in the above numerical range, the release agent can effectively act at the interface between a fixing roller and the toner, thereby improving high-temperature offset resistance of the toner without applying another release agent such as an oil to the fixing roller. Specifically, when the melting point of the release agent is 50 degrees C. or above, deterioration of heat-resistant storage stability of the toner can be prevented. When the melting point of the release agent is 120 degrees C. or below, deterioration of cold offset resistance and the occurrence of paper winding on a fixing device, which may be caused when releasability is not developed at low temperatures, can be prevented.

The melting point of the release agent can be determined from the maximum endothermic peak measured by a differential scanning calorimeter (TG-DSC system TAS-100 available from Rigaku Corporation).

The proportion of the release agent to the binder resin is preferably from 1% to 20% by mass, more preferably from 3% to 10% by mass. When the proportion of the release agent is 1% by mass or more, deterioration of the offset preventing effect can be prevented. When the proportion of the release agent is 20% by mass or less, deterioration of transferability and durability can be prevented.

The amount of the monoester wax contained in 100 parts by mass of the infrared-absorbing-pigment-containing toner is preferably from 4 to 8 parts by mass, more preferably from 5 to 7 parts by mass. When the amount of the monoester wax is 4 parts by mass or more, exudation to the surface of the toner at the time of fixing will not become insufficient and deterioration of releasability, gloss value, low-temperature fixability, and high-temperature offset resistance can be prevented. When the amount of the monoester wax is 8 parts by mass or less, deterioration of storage stability and filming property (on a photoconductor, etc.) of the toner, which may be caused when the amount of release agent deposited on the surface of the toner is increased, can be prevented.

Preferably, the toner according to an embodiment of the present invention contains a wax dispersing agent. Preferably, the wax dispersing agent is a copolymer composition comprising at least styrene, butyl acrylate, and acrylonitrile as monomers, or a polyethylene adduct of the copolymer composition.

The amount of the wax dispersing agent contained in 100 parts by mass of the infrared-absorbing-pigment-containing toner is preferably 7 parts by mass or less. The wax dispersing agent has an effect of dispersing the wax in the toner, so that storage stability of the toner is reliably improved regardless of production method of the toner. In addition, the diameter of the wax is reduced due to the effect of the wax dispersing agent, so that the toner is prevented from filming on a photoconductor, etc. When the amount of the wax dispersing agent is 7 parts by mass or less, various undesirable phenomena can be prevented. For example, a gloss decrease which may be caused due to an increase of the amount of polyester-incompatible components is prevented. Also, a decrease of low-temperature fixability and hot offset resistance which may be caused due to insufficient exudation of the wax to the surface of the toner at the time of fixing is prevented, because an excessive increase of dispersibility of the wax is prevented although filming resistance is improved.

Charge Controlling Agent

The charge controlling agent is not particularly limited and can be suitably selected to suit to a particular application. Specific examples thereof include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphorus and phosphorus-containing compounds, fluorine activators, metal salts of salicylic acid, and metal salts of salicylic acid derivatives. Each of these charge controlling agents may be used alone or in combination with others.

These charge controlling agents are available either synthetically or commercially. Specific examples of commercially-available products include, but are not limited to: BONTRON 03, BONTRON P-51, BONTRON S-34, E-82, E-84, and E-89 (available from Orient Chemical Industries Co., Ltd.); TP-302, TP-415, COPY CHARGE PSY VP2038, COPY BLUE PR, COPY CHARGE NEG VP2036, and COPY CHARGE NX VP434 (available from Hoechst AG); and LRA-901 and LR-147 (available from Japan Carlit Co., Ltd.).

The amount of the charge controlling agent contained in the toner can be appropriately determined depending on the type of the binder resin, the presence or absence of an additive, and/or the toner production method including dispersing method. Preferably, the amount of the charge controlling agent with respect to 100 parts by mass of the binder resin is from 0.1 to 5 parts by mass, more preferably from 0.2 to 2 parts by mass. When the amount of the charge controlling agent is 5 parts by mass or less, deterioration of developer fluidity and/or image density can be prevented because the chargeability of the toner is not so large that the effect of the charge controlling agent is not reduced and the electrostatic force between the toner and the developing roller is not increased.

External Additive

The external additive may be contained in the toner to assist fluidity, developability, and chargeability of the toner. The external additive is not particularly limited and can be suitably selected to suit to a particular application. Examples thereof include, but are not limited to, fine inorganic particles and fine polymeric particles.

Specific examples of the fine inorganic particles include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Each of these fine inorganic particles may be used alone or in combination with others.

Specific examples of the fine polymeric particles include, but are not limited to, polystyrene particles obtained by soap-free emulsion polymerization, suspension polymerization, or dispersion polymerization; particles of copolymer of methacrylates and/or acrylates; particles of polycondensation polymer such as silicone, benzoguanamine, and nylon; and thermosetting resin particles.

The external additive may be surface-treated with a surface treatment agent to improve its hydrophobicity to prevent deterioration of fluidity and chargeability even under high-humidity conditions.

Specific examples of the surface treatment agent include, but are not limited to, silane coupling agents, silylation agents, silane coupling agents having a fluorinated alkyl group, organic titanate coupling agents, aluminum coupling agents, silicone oils, and modified silicone oils.

The external additive preferably has a primary particle diameter of from 5 nm to 2 μm, more preferably from 5 to 500 nm. The external additive preferably has a specific surface area of from 20 to 500 $m^2/g$ when measured according to the BET method.

Preferably, the proportion of the external additive in the infrared-absorbing-pigment-containing toner is from 0.01% to 5% by mass, more preferably from 0.01% to 2.0% by mass.

Properties of Color Toner and Infrared-absorbing-pigment-containing Toner A color toner image formed by the color toner according to an embodiment of the present invention preferably has a gloss value lower than that of general offset printed matter.

Therefore, the binder resin contained in the color toner preferably contains gel, although the binder resin not particularly limited and can be suitably selected to suit to a particular application. The proportion of gel, i.e., gel fraction, in the binder resin is preferably from 0.5% to 20% by mass, more preferably from 1.0% to 10% by mass. Even in a case of containing no gel, the binder resin of the color toner preferably contains a high-molecular-weight component having a weight average molecular weight (Mwc) of 100,000 or higher, which is larger than the weight average molecular weight (Mwi) of the binder resin of the infrared-absorbing-pigment-containing toner. When the weight average molecular weight (Mwc) of the binder resin of the color toner is larger than the weight average molecular weight (Mwi) of the binder resin of the infrared-absorbing-pigment-containing toner, the resulting color image has a 60-degree gloss value of about 10 to 30, which has higher visibility than offset printed matter.

The 60-degree gloss value of the solid image formed of the infrared-absorbing-pigment-containing toner is preferably 30 or more, more preferably from 30 to 80, and much more preferably from 30 to 60. When the 60-degree gloss value of the solid image is 30 or more, the infrared-absorbing-pigment-containing toner image has low visibility and effectively functions as a concealed image. When the 60-degree gloss value of the solid image is 80 or less, the molecular weight of the binder resin of the toner is appropriate and a sufficient fixable temperature range is maintained.

The 60-degree gloss value of the solid image of the color toner is preferably from 10 to 40, more preferably from 15 to 35. When the 60-degree gloss value is from 10 to 40, the color toner image has a relatively low gloss.

Preferably, the 60-degree gloss value of the solid image of the infrared-absorbing-pigment-containing toner is higher than the 60-degree gloss value of the solid image of the color toner by 10 degrees or more, more preferably by 15 degrees or more, and much more preferably by 20 degrees or more. When the difference between the 60-degree gloss value of the solid image of the infrared-absorbing-pigment-containing toner and the 60-degree gloss value of the solid image of the color toner is 10 or more, in the case of superimposing the color toner image on the infrared-absorbing-pigment-containing toner image formed on a recording medium before image fixation is conducted, visibility of the color toner image is good because the color toner of the upper layer does not enter the lower infrared-absorbing-pigment-containing toner layer by application of heat and pressure at the image fixation. When the gloss value of the solid image of the infrared-absorbing-pigment-containing toner is higher than the gloss value of the solid image of the color toner, visibility of the color toner image on the upper layer is increased. As a result, the infrared-absorbing-pigment-containing toner image on the lower layer becomes difficult to visually recognize.

The absorbance of the solid image of the color toner at a wavelength of from 750 to 900 nm is preferably 0.01 or less.

The gloss value of the solid image of the infrared-absorbing-pigment-containing toner or color toner can be adjusted by, for example, adjusting the gel fraction in the binder resin or adjusting the weight average molecular weight of the binder resin. The greater the gel fraction in the binder resin, the lower the gloss value. The closer the gel fraction to 0, the higher the gloss value. In a case in which the binder resin is free of gel, the greater the weight average molecular weight of the binder resin, the lower the gloss value. In addition, the smaller the weight average molecular weight of the binder resin, the higher the gloss value.

When the binder resin comprises a resin having an acid value, the gloss value can be adjusted by adding a trivalent or higher metal salt thereto. As the acid value of the binder resin and the added amount of the trivalent or higher metal salt increase, the gloss value is likely to become lower. As the acid value of the binder resin and the added amount of the trivalent or higher metal salt decrease, the gloss value is likely to become higher.

The weight average molecular weight (Mwi) of the infrared-absorbing-pigment-containing toner is preferably from 6,000 to 12,000, more preferably from 7,500 to 10,000.

The weight average molecular weight can be determined from a molecular weight distribution of tetrahydrofuran (THF)-soluble matter that is measured with a GPC (gel permeation chromatography) measuring instrument GPC-150C (manufactured by Waters Corporation).

For example, the weight average molecular weight can be measured using columns (SHODEX KF 801 to 807 manufactured by Showa Denko K.K.) as follows.

The columns are stabilized in a heat chamber at 40 degrees C. THF as a solvent is let to flow in the columns at that temperature at a flow rate of 1 ml/min. Next, 0.05 g of a sample is thoroughly dissolved in 5 g of THF and thereafter filtered with a pretreatment filter (e.g., a chromatographic disk having a pore size of 0.45 μm (manufactured by KURABO INDUSTRIES LTD.)). Finally, a THF solution of the sample having a sample concentration of from 0.05% to 0.6% by mass is prepared. The THF solution of the sample thus prepared in an amount of from 50 to 200 μL is injected in the measuring instrument.

Preferably, the gel fraction in the infrared-absorbing-pigment-containing toner is from 0% to 2% by mass.

The gel fraction can be calculated from the dry weight of the component filtered by the pretreatment filter that is used for measuring weight average molecular weight.

The ratio (Mw/Mn) of the weight average molecular weight (Mw) to the number average molecular weight (Mn) of the infrared-absorbing-pigment-containing toner is preferably 5 or less, more preferably 4 or less.

The weight average molecular weight (Mw) and the number average molecular weight (Mn) are determined by comparing the molecular weight distribution of the infrared-absorbing-pigment-containing toner with a calibration curve created with several types of monodisperse polystyrene standard samples that shows the relation between the logarithmic values of molecular weights and the number of counts.

The polystyrene standard samples may be, for example, those having molecular weights of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, and $4.48\times10^6$, respectively (available from Pressure Chemical Company or Tosoh Corporation). Preferably, the calibration curve is created using at least 10 standard polystyrene samples. As the detector, a refractive index (RI) detector is used.

The acid value of the infrared-absorbing-pigment-containing toner is preferably 12 mgKOH/g or less, more preferably from 6 to 12 mgKOH/g. The acid value can be adjusted to be in the above numerical range when the binder resin comprises a polyester resin. In this case, it is easy to achieve both low-temperature fixability and hot offset resistance.

In the present disclosure, the acid values of the toner and the binder resin can be measured under the following conditions in accordance with the measuring method described in JIS (Japanese Industrial Standards) K 0070-1992.

First, a sample solution is prepared by dissolving 0.5 g (0.3 g in the case of ethyl acetate soluble component) of the toner or binder resin in 120 mL of toluene by stirring them at room temperature (23 degrees C.) for about 10 hours. Further, 30 mL of ethanol is mixed therein, thus preparing a sample solution.

The acid value is calculated as follows using an instrument. The sample solution is titrated with N/10 potassium hydroxide alcohol solution standardized in advance. The acid value is calculated from the consumed amount of the potassium hydroxide alcohol solution in the titration according to the following formula.

$$\text{Acid Value}=\text{KOH (mL)}\times N\times 56.1/\text{Mass of Sample}$$

where N represents the factor of the N/10 potassium hydroxide alcohol solution.

In the following Examples and Comparative Examples, the acid value of the binder resin and the acid value of the toner were substantially the same. Therefore, the acid value of the binder resin is treated as the acid value of the toner in the present disclosure.

Particle Diameter of Toner

The weight average particle diameter of the color toner and the infrared-absorbing-pigment-containing toner is preferably from 4 to 8 m, more preferably from 5 to 7 μm.

When the weight average particle diameter is within the above range, minute dots with 600 dpi or more can be reproduced and high quality images can be obtained. This is because the particle diameter of the toner particles is sufficiently smaller than minute dots of a latent image and thus excellent dot reproducibility is exhibited.

In particular, the infrared-absorbing-pigment-containing toner particles transferred onto a recording medium are arranged at a high density before getting fixed thereon, so that color toner particles superimposed on the infrared-absorbing-pigment-containing toner particles do not enter the gap between the infrared-absorbing-pigment-containing toner particles. Thus, the resulting fixed image can be obtained with high reproducibility. The image obtained with high reproducibility can be more reliably read by a machine upon infrared light irradiation.

When the weight average particle diameter (D4) of the color toner is 4 μm or more, undesirable phenomena such as reduction of transfer efficiency and deterioration of blade cleaning property can be prevented. When the weight average particle diameter (D4) of the color toner is 8 μm or less, undesirable phenomena can be prevented such as disturbance of image which may be caused when the color toner superimposed on an unfixed image gets into the image. In addition, scattering of texts and lines can be easily prevented.

The ratio (D4/D1) of the weight average particle diameter (D4) to the number average particle diameter (D1) is preferably from 1.00 to 1.40, more preferably from 1.05 to 1.30. The closer the ratio (D4/D1) to 1.00, the narrower the particle diameter distribution.

Such a toner having a small particle diameter and a narrow particle diameter distribution has a uniform charge amount distribution and thereby provides a high-quality image with less background fog. In addition, in an electrostatic transfer method, the transfer rate is increased.

In a full-color image forming method that forms a multicolor image by superimposing toner images of different colors, the amount of toner deposited on paper is larger compared to a monochrome image forming method that forms an image only with black toner without superimposing toner images of different colors. Therefore, the amount of toner to be developed, transferred, and fixed is increased, and the above-described undesirable phenomena that deteriorate image quality are likely to occur, such as reduction of transfer efficiency, deterioration of blade cleaning property, scattering of texts and lines, and background fog. Thus, the weight average particle diameter (D4) and the ratio (D4/D1) of the weight average particle diameter (D4) to the number average particle diameter (D1) should be properly controlled.

The particle size distribution of the toner particles can be measured using an apparatus for measuring particle size distribution of toner particles by the Coulter principle. Examples of such an apparatus for measuring particle size distribution include, but are not limited to, COULTER COUNTER TA II and COULTER MULTISIZER II (both available from Beckman Coulter Inc.).

Specific measurement procedures are as follows.

First, 0.1 to 5 mL of a surfactant (e.g., an alkylbenzene sulfonate), as a dispersant, is added to 100 to 150 mL of an electrolyte solution. Here, the electrolyte solution is an about 1% NaCl aqueous solution prepared with the first grade sodium chloride. As the electrolyte solution, for example, ISOTON-II (available from Beckman Coulter, Inc.) can be used.

Further, 2 to 20 mg of a sample is added thereto. The electrolyte solution in which the sample is suspended is subjected to a dispersion treatment using an ultrasonic disperser for about 1 to 3 minutes and then to the measurement of the weight and number of toner particles using the above-described apparatus equipped with a 100-μm aperture to calculate weight and number distributions. The weight average particle diameter (D4) and number average particle diameter (D1) of the toner can be calculated from the weight and number distributions obtained above.

Thirteen channels with the following ranges are used for the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Namely, particles having a particle diameter not less than 2.00 μm and less than 40.30 μm are to be measured.

It is generally known that the loss tangent (tan δ) of toner for electrophotographic development clearly correlates with the gloss value of an image formed with the toner. As tan δ increases, spreadability of toner is increased at the time of fixing and substrate hiding property of toner is enhanced, so that a high gloss image is obtained.

Preferably, the loss tangent (tan δi) of the infrared-absorbing-pigment-containing toner at from 100 to 140 degrees C. is 2.5 or more, more preferably 3.0 or more. In addition, preferably, tan δi is 15 or less. Here, a state in which the loss tangent (tan δi) of the infrared-absorbing-pigment-containing toner at from 100 to 140 degrees C. is 2.5 or more refers to a state in which the loss tangent (tan δi) of the infrared-absorbing-pigment-containing toner is always 2.5 or more in a temperature range of from 100 to 140 degrees C.

Preferably, the loss tangent (tan δc) of the color toner at from 100 to 140 degrees C. is 2 or less. In addition, preferably, tan δc is 0.1 or more. When the loss tangent of the color toner is 2 or less, the color toner superimposed on the infrared-absorbing-pigment-containing toner is prevented from entering the infrared-absorbing-pigment-containing toner image, thus preventing deterioration of stability of the infrared-absorbing-pigment-containing toner image. Here, a state in which the loss tangent (tan δc) of the color toner at from 100 to 140 degrees C. is 2 or less refers to a state in which the loss tangent (tan δc) of the color toner is always 2 or less in a temperature range of from 100 to 140 degrees C.

The loss tangent (tan δ) of toner for electrophotographic development is represented by the ratio (G"/G') of the loss elastic modulus (G") to the storage elastic modulus (G') that can be determined by viscoelasticity measurement. The loss elastic modulus (G") and the storage elastic modulus (G') can be measured by the following method. First, 0.8 g of the infrared-absorbing-pigment-containing toner or color toner is molded using a die having a diameter of 20 mm at a pressure of 30 MPa. The molded toner is subjected to a measurement of loss elastic modulus (G"), storage elastic modulus (G'), and loss tangent (tan δ) using an instrument ADVANCED RHEOMETRIC EXPANSION SYSTEM (manufactured by TA Instruments) equipped with a parallel cone having a diameter of 20 mm under a frequency of 1.0 Hz, a temperature rising rate of 2.0 degrees C./min, and a strain of 0.1% (under automatic strain control in which the allowable minimum stress is 1.0 g/cm, allowable maximum stress is 500 g/cm, maximum applied strain is 200%, and strain adjustment is 200%). GAP is set within a range such that FORCE becomes 0 to 100 gm after the sample is set.

Toner Production Method

The toner set according to an embodiment of the present invention may be produced by conventionally known methods such as melt-kneading-pulverization methods and polymerization methods. The color toner and the infrared-absorbing-pigment-containing toner may be produced by either the same production method or different production methods. For example, it is possible that the color toner is produced by a polymerization method and the infrared-absorbing-pigment-containing toner is produced by a melt-kneading-pulverization method.

Melt-Kneading-Pulverization Method

The melt-kneading-pulverization method includes the processes of (1) melt-kneading at least the binder resin, the colorant or infrared absorbing pigment, and the release agent, (2) pulverizing and classifying the melt-kneaded toner composition, and (3) externally adding fine inorganic particles. It is preferable that fine powder produced in the pulverizing and classifying process (2) is reused as a raw material in the process (1) for saving cost.

Examples of kneaders used for the kneading include, but are not limited to, closed kneaders, single-shaft or twin-shaft extruders, and open-roll kneaders. Specific examples of the kneaders include, but are not limited to, KRC KNEADER (available from Kurimoto, Ltd.); BUSS CO-KNEADER (available from Buss AG); TWIN SCREW COMPOUNDER TEM (available from Toshiba Machine Co., Ltd.); TWIN SCREW EXTRUDER TEX (available from The Japan Steel Works, Ltd.); TWIN SCREW EXTRUDER PCM (available from Ikegai Corp); THREE ROLL MILL, MIXING ROLL MILL, and KNEADER (available from Inoue Mfg., Inc.); KNEADEX (available from Nippon Coke & Engineering Company, Limited); MS TYPE DISPERSION MIXER and KNEADER-RUDER (available from Nihon Spindle Manufacturing Co., Ltd (formerly Moriyama Company Ltd.)), and BANBURY MIXER (available from Kobe Steel, Ltd.).

Depending on the conditions in the kneading process, the average diameter of the colorant or infrared absorbing pigment can be adjusted.

To more precisely control the dispersion state of the colorant or infrared absorbing pigment, a master batch thereof may be prepared.

The master batch is a pigment dispersion in which the colorant or infrared absorbing pigment is previously melt-kneaded in a binder resin at a relatively high concentration. When the colorant or infrared absorbing pigment is dispersed in the master batch so as to have an arbitrary average diameter, the toner materials can be kneaded under conditions that do not relatively damage the binder resin of the toner in the kneading process.

Specific examples of pulverizers include, but are not limited to, COUNTER JET MILL, MICRON JET, and INOMIZER (available from Hosokawa Micron Corporation); IDS-TYPE MILL and PJM JET MILL (available from Nippon Pneumatic Mfg. Co., Ltd.); CROSS JET MILL (available from Kurimoto, Ltd.); NSE-ULMAX (available from Nisso Engineering Co., Ltd.); SK JET-O-MILL (available from Seishin Enterprise Co., Ltd.); KRYPTRON (available from Kawasaki Heavy Industries, Ltd.); TURBO MILL (available from Freund-Turbo Corporation); and SUPER ROATER (available from Nisshin Engineering Inc.). Specific examples of classifiers include, but are not limited to, CLASSIEL, MICRON CLASSIFIER, and SPEDIC CLASSIFIER (available from Seishin Enterprise Co., Ltd.); TURBO CLASSIFIER (available from Nisshin Engineering Inc.); MICRON SEPARATOR, TURBOPLEX ATP, and TSP SEPARATOR (available from Hosokawa Micron Corporation); ELBOW JET (available from Nittetsu Mining Co., Ltd.); DISPERSION SEPARATOR (available from Nippon Pneumatic Mfg. Co., Ltd.); and YM MICRO CUT (available from URAS TECHNO CO., LTD. (formerly Yaskawa & Co., Ltd.)).

Specific examples of sieving devices for sieving coarse particles include, but are not limited to, ULTRASONIC (available from Koei Sangyo Co., Ltd.); RESONASIEVE and GYRO-SIFTER (available from Tokuju Corporation); VIBRASONIC SYSTEM (available from DALTON CORPORATION); SONICLEAN (available from SINTOKOGIO, LTD.); TURBO SCREENER (available from FREUND-TURBO CORPORATION); MICRO SIFTER (available from MAKINO MFG. CO., LTD.); and circular vibration sieves.

Polymerization Method

The polymerization method is not particularly limited and conventionally known methods may be used. The polymerization method may be conducted by the following procedure. First, the colorant, the binder resin, and the release agent are dispersed in an organic solvent to prepare a toner material liquid (or "oil phase"). Preferably, a polyester prepolymer (A) having an isocyanate group is added to the toner material liquid and allowed to react during granulation so as to form a urea-modified polyester resin in the resulting toner.

In the polymerization method, either the master batch of the colorant or infrared absorbing pigment may be dissolved in an organic solvent, or the dispersion state of the colorant or infrared absorbing pigment may be controlled in the organic solvent.

Next, the toner material liquid is emulsified in an aqueous medium in the presence of a surfactant and fine resin particles.

The aqueous medium comprises an aqueous solvent. The aqueous solvent may comprise water alone or may further comprise an organic solvent such as an alcohol.

The used amount of the aqueous solvent is preferably from 50 to 2,000 parts by mass, more preferably from 100 to 1,000 parts by mass, with respect to 100 parts by mass of the toner material liquid.

The fine resin particles are not particularly limited and can be suitably selected to suit to a particular application as long as they are capable of forming an aqueous dispersion thereof. Examples thereof include, but are not limited to, vinyl resins, polyurethane resins, epoxy resins, and polyester resins.

After the toner material liquid is emulsified (dispersed) in the aqueous medium, the emulsion (i.e., reactant) is subjected to removal of the organic solvent and subsequent washing and drying to obtain mother toner particles.

The color toner and the infrared-absorbing-pigment-containing toner each can be used for either a one-component developer or a two-component developer.

In a case in which the toner set according to an embodiment of the present invention is used for a two-component developer, the toner is mixed with a magnetic carrier. The amount of the toner in the developer is preferably from 1 to 10 parts by mass based on 100 parts by mass of the carrier. Examples of the magnetic carrier include, but are not limited to, conventionally known materials such as iron powder, ferrite powder, magnetite powder, and magnetic resin carriers, each having a particle diameter of about 20 to 200 μm.

Such magnetic carriers may be coated magnetic carriers. Specific examples of coating materials for coating the magnetic carrier include, but are not limited to, amino resins (e.g., urea-formaldehyde resin, melamine resin, benzoguanamine resin, urea resin, polyamide resin, epoxy resin), polyvinyl and polyvinylidene resins (e.g., acrylic resin, polymethyl methacrylate resin, polyacrylonitrile resin, polyvinyl acetate resin, polyvinyl alcohol resin, polyvinyl butyral resin), styrene resins (e.g., polystyrene resin, styrene-acrylic copolymer resin), halogenated olefin resins (e.g., polyvinyl chloride), polyester resins (e.g., polyethylene terephthalate resin, polybutylene terephthalate resin), polycarbonate resins, polyethylene resins, polyvinyl fluoride resins, polyvinylidene fluoride resins, poly(trifluoroethylene) resins, poly(hexafluoropropylene) resins, vinylidene fluoride-acrylic copolymer, vinylidene fluoride-vinyl fluoride copolymer, tetrafluoroethylene-vinylidene fluoride-non-fluoride monomer terpolymer, and silicone resins.

The coating material may contain a conductive powder, as necessary. Specific examples of the conductive powder include, but are not limited to, metal powder, carbon black, titanium oxide, tin oxide, and zinc oxide. Preferably, the conductive powder has an average particle diameter of 1 μm or less. When the average particle diameter of the conductive powder is 1 μm or less, it will not be difficult to control electrical resistance.

Image Forming Apparatus and Image Forming Method

An image forming apparatus according to an embodiment of the present invention includes: an electrostatic latent image bearer; an electrostatic latent image forming device configured to form an electrostatic latent image on the electrostatic latent image bearer; a developing device containing the toner set according to an embodiment of the present invention, configured to develop the electrostatic latent image with the toner set to form a toner image comprising an infrared-absorbing-pigment-containing toner image and a color toner image; a transfer device configured to transfer the toner image onto a recording medium; and a fixing device configured to fix the toner image on the recording medium. The image forming apparatus may further include other devices appropriately selected as necessary.

Preferably, the image forming apparatus according to an embodiment of the present invention is further configured to: form a colored layer overlying the recording medium, which comprises the color toner image; and form an infrared-absorbing-pigment-containing layer overlying the recording medium and underlying the colored layer, which comprises the infrared-absorbing-pigment-containing toner image.

An image forming method according to an embodiment of the present invention includes the processes of: forming an electrostatic latent image on an electrostatic latent image bearer; developing the electrostatic latent image with the toner set according to an embodiment of the present invention to form a toner image comprising an infrared-absorbing-pigment-containing toner image and a color toner image; transferring the toner image onto a recording medium; and fixing the toner image on the recording medium. The image forming method may further includes other processes appropriately selected as necessary.

Preferably, the image forming method according to an embodiment of the present invention further includes the processes of: forming a colored layer overlying the recording medium, which comprises the color toner image; and forming an infrared-absorbing-pigment-containing layer overlying the recording medium and underlying the colored layer, which comprises the infrared-absorbing-pigment-containing toner image.

On the recording medium, the infrared-absorbing-pigment-containing toner image is formed closer to the recording medium than the color toner image is. The infrared-absorbing-pigment-containing toner image can be formed closer to the recording medium than the color toner image by, for example, forming the color toner image after the infrared-absorbing-pigment-containing toner image is formed on the recording medium.

The number of color toners used to form the color toner image is not particularly limited and can be suitably selected to suit to a particular application. In the case of using a plurality of color toners, the color toner image may be formed by either using the multiple color toners at the same time or repeatedly forming a single color toner image with each toner and superimposing the single color toner images. The latter is more preferred. In forming the color toner image, the order of forming each single color toner image is not particularly limited.

The deposition amount of the infrared-absorbing-pigment-containing toner in the infrared-absorbing-pigment-containing toner image is preferably from 0.30 to 0.45 $mg/cm^2$, more preferably from 0.35 to 0.40 $mg/cm^2$. When the deposition amount of the infrared-absorbing-pigment-containing toner is 0.30 $mg/cm^2$ or more, the rate of hiding of the substrate by the image is sufficient and a reliable image can be obtained.

Since the infrared absorbing pigment has slight absorption in the visible light region and is not completely colorless, as the amount of the infrared absorbing pigment added to the toner increases, visibility is increased. When the deposition amount of the infrared-absorbing-pigment-containing toner is 0.45 $mg/cm^2$ or less, visibility is decreased.

Electrostatic Latent Image Bearer

The electrostatic latent image bearer (hereinafter may be referred to as "electrophotographic photoconductor", "photoconductor", or "image bearer") is not limited in material, shape, structure, and size, and can be appropriately selected from known materials. The shape of the electrostatic latent image bearer may be, for example, a drum-like shape or a belt-like shape. The material of the electrostatic latent image bearer may comprise, for example, inorganic photoconductors such as amorphous silicon and selenium, and organic photoconductors (OPC) such as polysilane and phthalopolymethine.

Electrostatic Latent Image Forming Process and Electrostatic Latent Image Forming Device The electrostatic latent image forming process is a process in which an electrostatic latent image is formed on an electrostatic latent image bearer. The formation of the electrostatic latent image can be conducted by, for example, uniformly charging a surface of the electrostatic latent image bearer and irradiating the surface with light containing image information by the electrostatic latent image forming device.

The electrostatic latent image forming device may include at least a charger to uniformly charge a surface of the electrostatic latent image bearer and an irradiator to irradiate the surface of the electrostatic latent image bearer with light containing image information.

The charging can be conducted by, for example, applying a voltage to a surface of the electrostatic latent image bearer by the charger.

The charger is not particularly limited and can be suitably selected to suit to a particular application. Specific examples thereof include, but are not limited to, contact chargers equipped with a conductive or semiconductive roller, brush, film, or rubber blade and non-contact chargers employing corona discharge such as corotron and scorotron.

Preferably, the charger is disposed in or out of contact with the electrostatic latent image bearer and configured to charge the surface of the electrostatic latent image bearer by applying direct-current and alternating-current voltages in superimposition thereto.

Preferably, the charger is a charging roller disposed close to but out of contact with the electrostatic latent image bearer via a gap tape and configured to charge the surface of the electrostatic latent image bearer by applying direct-current and alternating-current voltages in superimposition thereto.

The irradiation can be conducted by, for example, irradiating the surface of the electrostatic latent image bearer with light containing image information by the irradiator. The irradiator is not particularly limited and can be suitably selected to suit to a particular application as long as it is capable of irradiating the surface of the electrostatic latent image bearer charged by the charger with light containing image information. Specific examples thereof include, but are not limited to, various irradiators of radiation optical system type, rod lens array type, laser optical type, and liquid crystal shutter optical type.

The irradiation can also be conducted by irradiating the back surface of the electrostatic latent image bearer with light containing image information.

Developing Process and Developing Device

The developing process is a process in which the electrostatic latent image is developed into a toner image with the toner set.

The formation of the toner image can be conducted by, for example, developing the electrostatic latent image with the toner set by the developing device.

Preferably, the developing device includes developing units storing respective toners of the toner set, each configured to apply the toner to the electrostatic latent image by contacting or without contacting the electrostatic latent image. More preferably, each developing unit is equipped with a container containing the toner.

The developing unit may be either a monochrome developing unit or a multicolor developing unit. Preferably, the developing unit includes a stirrer that frictionally stirs and charges the toner of the toner set (hereinafter simply "toner") and a rotatable magnet roller.

In the developing unit, toner particles and carrier particles are mixed and stirred. The toner particles are charged by friction and retained on the surface of the rotating magnet roller, thus forming magnetic brush. The magnet roller is disposed proximity to the electrostatic latent image bearer (photoconductor), so that a part of the toner particles composing the magnetic brush formed on the surface of the magnet roller are moved to the surface of the electrostatic latent image bearer (photoconductor) by an electric attractive force. As a result, the electrostatic latent image is developed with the toner particles and a toner image is formed with the toner particles on the surface of the electrostatic latent image bearer (photoconductor).

The toner image includes the infrared-absorbing-pigment-containing toner image formed with the infrared-absorbing-pigment-containing toner and the color toner image formed with the color toner.

The colors constituting the color toner may include, for example, a set of four colors including black (Bk), cyan (C), magenta (M), and yellow (Y), a set of three colors including cyan (C), magenta (M), and yellow (Y), or a single color of black (Bk). Among these, the set of four colors is preferable. It can be mounted on a general electrophotographic image forming apparatus using four color toners.

Fixing Process and Fixing Device

The fixing process is a process in which an image transferred onto the recording medium is fixed thereon. The fixing process may be conducted every time each color developer is transferred onto the recording medium. Alternatively, the fixing process may be conducted at once after all color developers are superimposed on one another on the recording medium.

The fixing device is not particularly limited and can be suitably selected to suit to a particular application as long as it is capable of fixing the transferred image on the recording medium. Preferred examples of the fixing device include a heat-pressure member. Specific examples of the heat-pressure member include, but are not limited to, a combination of a heat roller and a pressure roller; and a combination of a heat roller, a pressure roller, and an endless belt.

Preferably, the fixing device includes a heater equipped with a heat generator, a film in contact with the heater, and a pressurizer pressed against the heater via the film, and is configured to allow a recording medium having an unfixed image thereon to pass through between the film and the pressurizer, so that the unfixed image is fixed on the recording medium by application of heat. The heating temperature of the heat-pressure member is preferably from 80 to 200 degrees C.

The fixing device may be used together with or replaced with an optical fixer according to the purpose.

Other Processes and Other Devices

The other processes may include, for example, a neutralization process, a cleaning process, and a control process.

The other devices may include, for example, a neutralizer, a cleaner, and a controller.

The neutralization process is a process in which a neutralization bias is applied to the electrostatic latent image bearer to neutralize the electrostatic latent image bearer, and is preferably conducted by a neutralizer.

The neutralizer is not particularly limited and can be appropriately selected from known neutralizers as long as it is capable of applying a neutralization bias to the electrostatic latent image bearer. Preferred examples thereof include, but are not limited to, a neutralization lamp.

The cleaning process is a process in which residual toner particles remaining on the electrostatic latent image bearer are removed, and is preferably conducted by a cleaner.

The cleaner is not particularly limited and can be appropriately selected from known cleaners as long as it is capable of removing residual toner particles remaining on the electrostatic latent image bearer. Preferred examples thereof include, but are not limited to, magnetic brush cleaner, electrostatic brush cleaner, magnetic roller cleaner, blade cleaner, brush cleaner, and web cleaner.

The control process is a process in which the above-described processes are controlled, and is preferably conducted by a controller.

The controller is not particularly limited and can be suitably selected to suit to a particular application as long as it is capable of controlling the above-described devices. Specific examples thereof include, but are not limited to, a sequencer and a computer.

Figure 2:
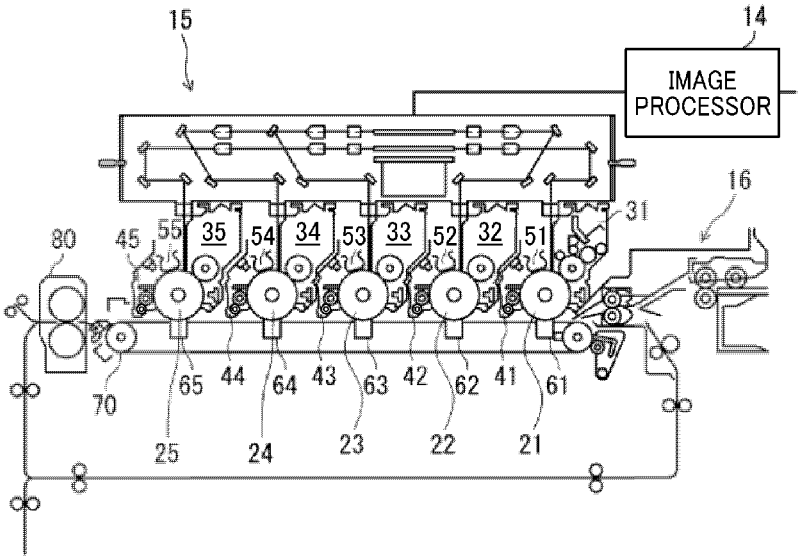
FIG. 2 is a schematic view of an image forming apparatus according to an embodiment of the present invention.

Details of the image forming method and the image forming apparatus according to some embodiments of the present invention are described below with reference to the drawings. FIG. 2 is a schematic diagram illustrating an image forming apparatus according to an embodiment of the present invention.

Image data sent to an image processor 14 generates image signals of five colors including Iv (invisible), Y (yellow), M (magenta), C (cyan), and Bk (black).

Next, the image processor 14 transmits the image signals of Iv, Y, M, C, and Bk to a writing device 15. The writing device 15 modulates five laser beams corresponding to Iv, Y, M, C, and Bk image signals and scans respective photoconductor drums 21, 22, 23, 24, and 25 having been charged by respective chargers 51, 52, 53, 54, and 55, thus sequentially forming respective electrostatic latent images thereon. Here, as an example, the first photoconductor drum 21 corresponds to Iv, the second photoconductor drum 22 corresponds to Y, the third photoconductor drum 23 corresponds to M, the fourth photoconductor drum 24 corresponds to C, and the fifth photoconductor drum 25 corresponds to Bk.

Next, developing units 31, 32, 33, 34, and 35, serving as the developing device, form toner images of respective colors on the respective photoconductor drums 21, 22, 23, 24, and 25. A sheet feeder 16 feeds a recording medium onto a conveyance belt 70. Transfer chargers 61, 62, 63, 64, and 65 sequentially transfer each toner image onto the respective photoconductor drums 21, 22, 23, 24, and 25.

After completion of the transfer process, the recording medium is conveyed to a fixing device 80. The fixing device 80 fixes the transferred toner image on the recording medium.

After completion of the transfer process, residual toner particles remaining on the photoconductor drums 21, 22, 23, 24, and 25 are removed by respective cleaners 41, 42, 43, 44, and 45.

Figure 4:
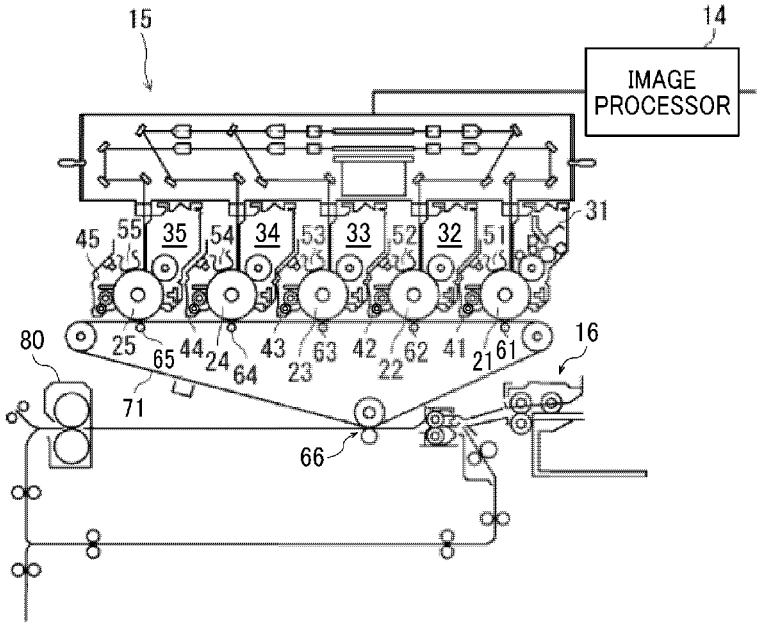
FIG. 4 is a schematic view of an image forming apparatus according to an embodiment of the present invention.

In an image forming apparatus illustrated in FIG. 4 and an image forming method using this image forming apparatus, toner images are formed on the photoconductor drums 21, 22, 23, 24, and 25 in the same manner as in FIG. 2 and then temporarily transferred onto a transfer belt 71. Next, the toner images are transferred onto the recording medium by a secondary transfer device 66 and fixed thereon in the fixing device 80. In this case, as an example, the first photoconductor drum 21 corresponds to Bk, the second photoconductor drum 22 corresponds to Y, the third photoconductor drum 23 corresponds to M, the fourth photoconductor drum 24 corresponds to C, and the fifth photoconductor drum 25 corresponds to Iv.

In forming the infrared-absorbing-pigment-containing layer as the lower layer on the recording medium, the image forming method using the image forming apparatus illustrated in FIG. 2 (hereinafter "image forming method 1") requires that the first photoconductor drum 21 correspond to Iv, and the image forming method using the image forming apparatus illustrated in FIG. 4 (hereinafter "image forming method 2") requires that the fifth photoconductor drum 25 correspond to Iv. The order of the colors corresponding to the other photoconductor drums is not limited.

Each of the image forming method 1 and the image forming method 2 has been described above to use five image forming units (including the photoconductor drum, etc.). However, the number of the image forming units is not limited thereto. There may be at least one image forming unit other than the invisible image forming unit.

Figure 3:
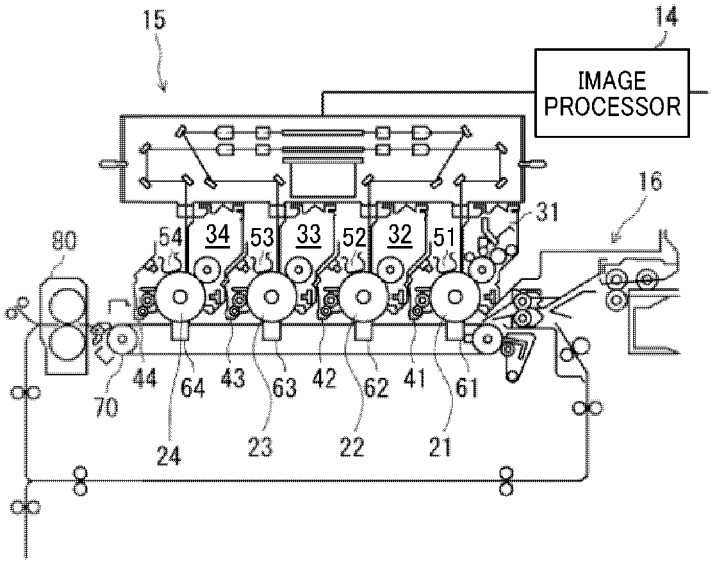
FIG. 3 is a schematic view of an image forming apparatus according to an embodiment of the present invention.
Figure 5:
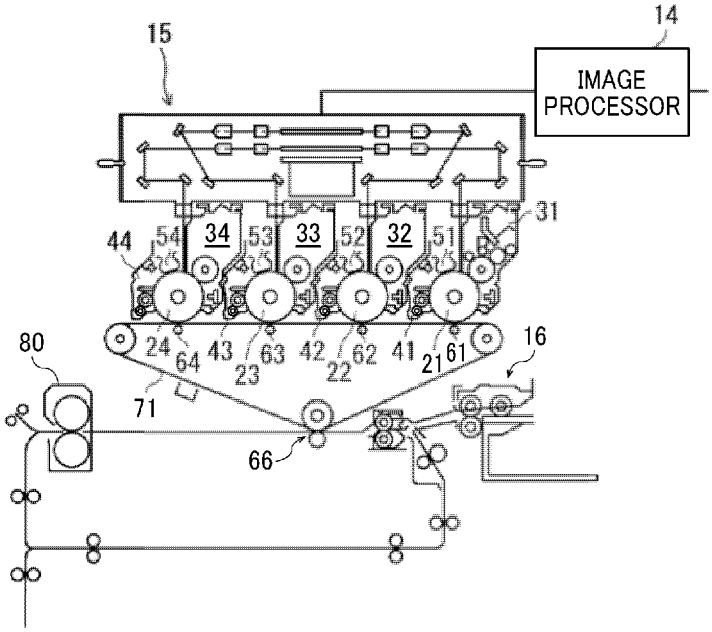
FIG. 5 is a schematic view of an image forming apparatus according to an embodiment of the present invention.

For example, in a case in which the number of image forming units (including the photoconductor drum, etc.) is four as illustrated in FIGS. 3 and 5, it is preferable that the image forming units respectively correspond to C, M, Y, and Iv. In this case, black color is represented by superposition of C, M, and Y.

Next, the peripheral configuration of the developing unit is described below.

Figure 6:
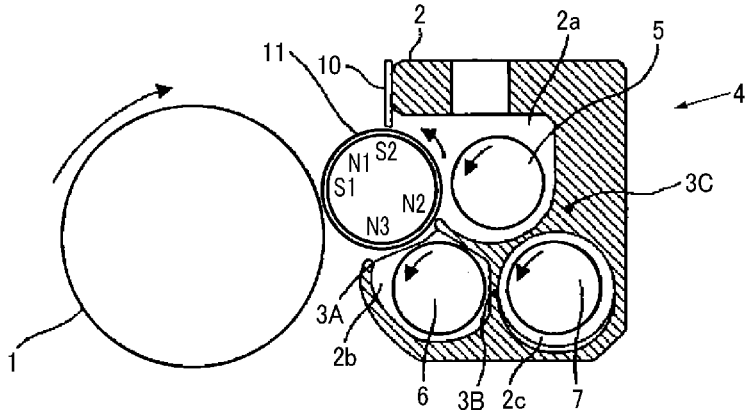
FIG. 6 is a cross-sectional view of a developing device in an image forming apparatus according to an embodiment of the present invention.

FIG. 6 is a schematic view illustrating a developing unit 4 and a photoconductor drum 1. The developing unit 4 represents one of the developing units 31, 32, 33, 34, and 35 each having almost the same configuration except for handling different color toners. The photoconductor drum 1 represents one of the photoconductor drums 21, 22, 23, 24, and 25 each having almost the same configuration except for handling different color toners.

The developing unit 4 includes a developer container 2 containing a two-component developer. A developing sleeve 11 as a developer bearer is rotatably disposed at an opening of the developer container 2 facing the photoconductor drum 1 (hereinafter simply "photoconductor 1") with a predetermined distance from the photoconductor 1. The developing sleeve 11 is formed of a cylinder made of a non-magnetic material. The developing sleeve 11 rotates such that the developing sleeve 11 moves in the same direction as the photoconductor 1 that rotates in the direction indicated by arrow in FIG. 6, at a portion where they are facing each other. Inside the developing sleeve 11, a magnet roller as a magnetic field generator is fixedly disposed. The magnet roller has five magnetic poles N1, S1, N2, N3, and S2. A regulation blade 10 as a developer regulator is attached to a portion of the developer container 2 above the developing sleeve 11. The regulation blade 10 is disposed out of contact with the developing sleeve 11 toward the vicinity of the magnetic pole S2 that is approximately positioned at the uppermost point of the magnet roller in the vertical direction.

In the developer container 2, a supplying conveyance path 2*a*, a collecting conveyance path 2*b*, and a stirring conveyance path 2*c* are disposed. The supplying conveyance path 2*a* accommodates a supplying screw 5 as a first developer stirring conveyer. The collecting conveyance path 2*b* accommodates a collecting screw 6 as a second developer stirring conveyer. The stirring conveyance path 2*c* accommodates a stirring screw 7 as a third developer stirring conveyer. The supplying conveyance path 2*a* and the stirring conveyance path 2*c* are disposed obliquely in the vertical direction. The collecting conveyance path 2*b* is disposed substantially horizontal to the stirring conveyance path 2*c* on the downstream side of the developing region of the developing sleeve 11.

The two-component developer contained in the developer container 2 is stirred and conveyed by the supplying screw 5, the collecting screw 6, and the stirring screw 7 within the supplying conveyance path 2*a*, the collecting conveyance path 2*b*, and the stirring conveyance path 2*c* and supplied to the developing sleeve 11 from the supplying conveyance path 2*a*. The developer supplied to the developing sleeve 11 is drawn up onto the developing sleeve 11 by the magnetic pole N2 of the magnet roller. As the developing sleeve 11 rotates, the developer is conveyed from the magnetic pole S2 to the magnetic pole S1 via the magnetic pole N1 on the developing sleeve 11. Thus, the developer reaches the developing region where the developing sleeve 11 and the photoconductor 1 are facing. During the conveyance of the developer, the regulation blade 10 magnetically regulates the layer thickness of the developer in cooperation with the magnetic pole S2. As a result, a thin layer of the developer is formed on the developing sleeve 11. The magnetic pole S1 of the magnet roller, positioned in the developing region of the developing sleeve 11, is the main developing pole. The developer conveyed to the developing region is formed into a magnetic brush by the magnetic pole S1 and brought into contact with the surface of the photoconductor 1, thereby developing the electrostatic latent image formed on the surface of the photoconductor 1.

The developer having been used for developing the electrostatic latent image is returned to the developer container 2 via the developing region and the transport pole N3 as the developing sleeve 11 rotates. The developer is then separated from the developing sleeve 11 by the repulsive magnetic fields of the magnetic poles N2 and N3 and collected into the collecting conveyance path 2*b* by the collecting screw 6.

Figure 7:
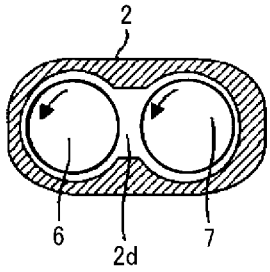
FIG. 7 is a cross-sectional view of a collecting conveyance path and a stirring conveyance path in an image forming apparatus according to an embodiment of the present invention, at a downstream portion of the collecting conveyance path with respect to the direction of conveyance of developer.

The supplying conveyance path 2*a* and the collecting conveyance path 2*b* disposed obliquely below the supplying conveyance path 2*a* are separated by a first partition 3A. The collecting conveyance path 2*b* and the stirring conveyance path 2*c* disposed laterally to each other are separated by a second partition 3B. The second partition 3B has an opening for supplying the developer collected into the collecting conveyance path 2*b* to the stirring conveyance path 2*c* on a downstream portion thereof with respect to the direction of conveyance of developer by the collecting screw 6 in the collecting conveyance path 2*b*. FIG. 7 is a cross-sectional view of the collecting conveyance path 2*b* and the stirring conveyance path 2*c* at a downstream portion with respect to the direction of conveyance of developer by the collecting screw 6. An opening 2*d* communicating the collecting conveyance path 2*b* and the stirring conveyance path 2*c* is provided.

The supplying conveyance path 2*a* and the stirring conveyance path 2*c* disposed obliquely below the supplying conveyance path 2*a* are separated by a third partition 3C. The third partition 3C has respective openings for supplying the developer on an upstream portion and a downstream portion thereof with respect to the direction of conveyance of developer by the supplying screw 5 in the supplying conveyance path 2*a*.

Figure 8:
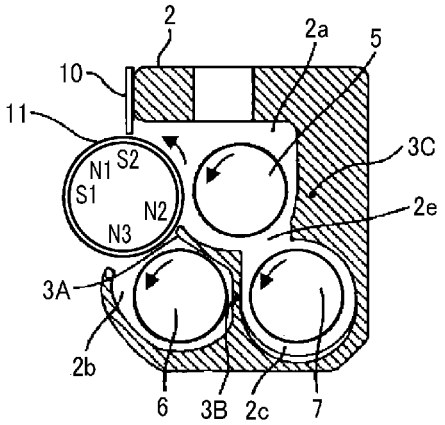
FIG. 8 is a cross-sectional view of an image forming apparatus according to an embodiment of the present invention, at an upstream portion of a supplying conveyance path with respect to the direction of conveyance of developer.

FIG. 8 is a cross-sectional view of the developing unit 4 at an upstream portion with respect to the direction of conveyance of developer by the supplying screw 5. The third partition 3C has an opening 2*e* communicating the stirring conveyance path 2*c* and the supplying conveyance path 2*a*.

Figure 9:
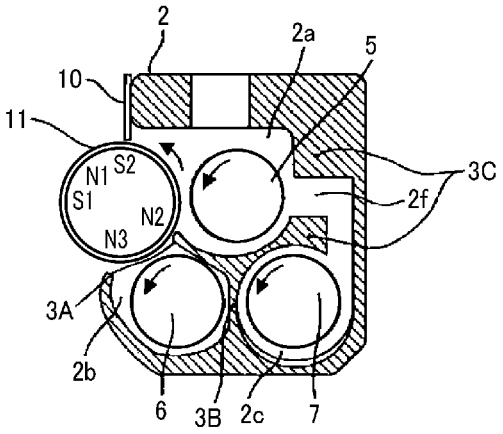
FIG. 9 is a cross-sectional view of an image forming apparatus according to an embodiment of the present invention, at a downstream portion of a supplying conveyance path with respect to the direction of conveyance of developer.

FIG. 9 is a cross-sectional view of the developing unit 4 at a downstream portion with respect to the direction of conveyance of developer by the supplying screw 5. The third partition 3C has an opening 2*f* communicating the stirring conveyance path 2*c* and the supplying conveyance path 2*a*.

Next, circulation of the developer in the three developer conveyance paths is described below.

Figure 10:
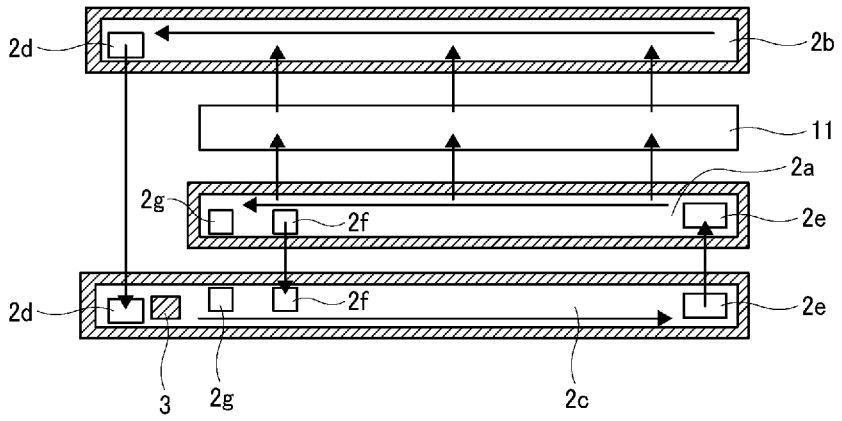
FIG. 10 is a schematic diagram illustrating the flow of developer in the developing device.

FIG. 10 is a schematic diagram illustrating the flow of the developer in the developing unit 4. Each arrow in FIG. 10 indicates the direction of movement of the developer. In the supplying conveyance path 2*a*, the developer supplied from the stirring conveyance path 2*c* is conveyed downstream with respect to the direction of conveyance of developer by the supplying screw 5 while the developer is supplied to the developing sleeve 11. An excess developer having been conveyed to a downstream portion in the supplying conveyance path 2*a* with respect to the direction of conveyance of developer without being supplied to the developing sleeve 11 is supplied to the stirring conveyance path 2*c* through the opening 2*f* as the first developer supply opening provided on the third partition 3C.

The developer having been collected from the developing sleeve 11 into the collecting conveyance path 2*b* by the collecting screw 6 is conveyed to a downstream portion in the collecting conveyance path 2*b*, in the same direction as the direction of conveyance of developer in the supplying conveyance path 2*a*. The developer is then supplied to the stirring conveyance path 2*c* through the opening 2*d* as the second developer supply opening provided on the second partition 3B.

The excess developer and the collected developer having been supplied to the stirring conveyance path 2*c* are stirred by the stirring screw 7 and conveyed in the direction opposite to the direction of conveyance of the developer in the collecting conveyance path 2*b* and the supplying conveyance path 2*a*. The developer having been conveyed to a downstream portion in the stirring conveyance path 2*c* with respect to the direction of conveyance of developer is supplied to an upstream portion in the supplying conveyance path 2*a* with respect to the direction of conveyance of developer through the opening 2*e* as the third developer supply opening provided on the third partition 3C.

A toner concentration sensor is disposed below the stirring conveyance path 2*c*. The toner concentration sensor operates a toner supply controller to supply toner from a toner container. In the stirring conveyance path 2*c*, a toner supplied through a toner supply opening 3, as needed, is conveyed by the stirring screw 7 downstream with respect to the direction of conveyance of developer while being stirred with the collected developer and the excess developer. It is preferable that the toner is supplied upstream of the stirring screw 7 for extending the stirring time from the supply to the development.

The developing unit 4 includes the supplying conveyance path 2*a* and the collecting conveyance path 2*b*, so that supply and collection of the developer are performed in separated developer conveyance paths. Therefore, the developer having been used for the development is prevented from coming into the supplying conveyance path 2*a*. Thus, a decrease of the toner concentration in the developer supplied to the developing sleeve 11 is more prevented at the more downstream side in the supplying conveyance path 2*a* with respect to the direction of conveyance of developer. In addition, since the collecting conveyance path 2*b* and the stirring conveyance path 2*c* are provided to perform collection and stirring of the developer in separated developer conveyance paths, the developer having been used for the development is prevented from falling during the stirring. Therefore, the developer having been sufficiently stirred is supplied to the supplying conveyance path 2*a*. Insufficient stirring of the developer to be supplied to the supplying conveyance path 2*a* is prevented.

Thus, both a decrease of the toner concentration in the developer in the supplying conveyance path 2*a* and insufficient stirring of the developer in the supplying conveyance path 2*a* are prevented, thereby making the image density constant during the development.

At an upstream portion in the supplying conveyance path 2*a* with respect to the direction of conveyance of developer, as illustrated in FIG. 8, the developer is supplied from the stirring conveyance path 2*c*, disposed obliquely below the supplying conveyance path 2*a*, upwardly to the supplying conveyance path 2*a*. Specifically, the stirring screw 7 rotates to push the developer into the opening 2*e* to cause the developer to overflow from the opening 2*e*, thereby supplying the developer to the supplying conveyance path 2*a*. Such a movement of the developer gives stress to the developer and reduces the lifespan of the developer.

In the developing unit 4, the supplying conveyance path 2*a* is disposed obliquely above the stirring conveyance path 2*c*. This configuration makes it possible to reduce stress given to the developer during movement of the developer upward as compared with a case in which the supplying conveyance path 2*a* is disposed vertically above the stirring conveyance path 2*c*.

At a downstream portion with respect to the direction of conveyance of developer by the supplying screw 5, as illustrated in FIG. 9, the opening 2*f* communicating the supplying conveyance path 2*a* and the stirring conveyance path 2*c* is provided for supplying the developer from the supplying conveyance path 2*a* to the stirring conveyance path 2*c* disposed obliquely below the supplying conveyance path 2*a*. The third partition 3C separating the stirring conveyance path 2*c* and the supplying conveyance path 2*a* extends upward from the lowest point of the supplying conveyance path 2*a*. The opening 2*f* is positioned above the lowest point.

Figure 11:
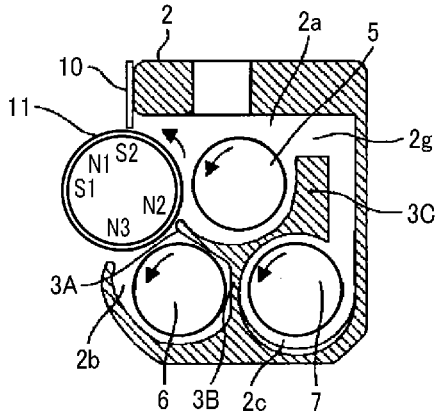
FIG. 11 is a cross-sectional view of another developing device in the image forming apparatus, at the most downstream portion of the supplying conveyance path with respect to the direction of conveyance of developer.

FIG. 11 is a cross-sectional view of the developing unit 4 at the most downstream portion with respect to the direction of conveyance of developer by the supplying screw 5. As illustrated in FIG. 11, the third partition 3C has an opening 2*g* communicating the stirring conveyance path 2*c* and the supplying conveyance path 2*a* on a downstream portion from the opening 2*f* with respect to the direction of conveyance of developer by the supplying screw 5.

The opening 2*g* is positioned above the uppermost part of the opening 2*f*.

In the supplying conveyance path 2*a* having the openings 2*f* and 2*g*, the developer is conveyed in the axial direction of the supplying conveyance path 2*a* toward the opening 2*f* by the supplying screw 5. The developer having reached the lowermost part of the opening 2*f* falls into the stirring conveyance path 2*c* disposed therebelow through the opening 2*f*. By contrast, the developer failed to reach the lowermost part of the opening 2*f* is supplied to the developing sleeve 11 while being conveyed further downstream by the supplying screw 5. Therefore, on the downstream side of the opening 2*f* in the supplying conveyance path 2*a*, the bulk of the developer gradually becomes lower than the lowermost part of the opening 2*f*. The bulk of the developer may be high at the most downstream end, since the most downstream end of the supplying conveyance path 2*a* is a dead end. However, when the bulk comes to have a certain height, the developer is pushed back against rotation of the supplying screw 5 and returned to the opening 2*f*. The developer having reached the lowermost part of the opening 2*f* falls into the stirring conveyance path 2*c* disposed therebelow through the opening 2*f*. Therefore, on the downstream side of the opening 2*f* in the supplying conveyance path 2*a*, the bulk of the developer is not kept increasing but kept in an equilibrium state with a gradient near the lowermost part of the opening 2*f*. When the opening 2*g* is disposed higher than the uppermost part of the opening 2*f*, in other words, disposed higher than the position of the equilibrium state, there is little possibility that the opening 2*f* is clogged with the developer and ventilation becomes insufficient. Thus, sufficient ventilation can be secured between the stirring conveyance path 2*c* and the supplying conveyance path 2*a*. The opening 2*g* has a function of ensuring sufficient ventilation between the supplying conveyance path 2*a* and the stirring conveyance path 2*c* rather than a function of supplying developer between the supplying conveyance path 2*a* and the stirring conveyance path 2*c*. By providing the opening 2*g* for ventilation, even when the internal pressure rises in the stirring conveyance path 2*c* and the collecting conveyance path 2*b* communicating with the stirring conveyance path 2*c* each disposed on a lower side, sufficient ventilation is secured between them and the supplying conveyance path 2*a* disposed on an upper side and equipped with a filter for passing air, thereby preventing an increase of the internal pressure of the entire developing unit 4.

The toner set according to an embodiment of the present invention may be contained in a process cartridge that integrally supports a photoconductor and at least one of an electrostatic latent image forming device, a developing device, and a cleaner and is detachably mountable on an image forming apparatus body.

Figure 12:
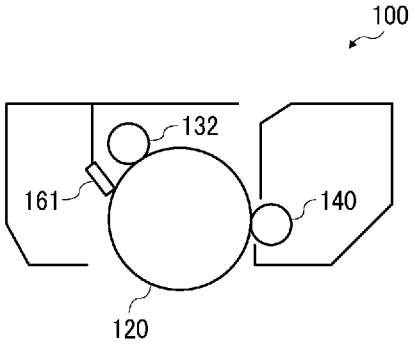
FIG. 12 is a schematic view of a process cartridge according to an embodiment of the present invention.

FIG. 12 is a schematic view of a process cartridge according to an embodiment of the present invention.

Referring to FIG. 12, a process cartridge 100 includes a photoconductor 120, an electrostatic latent image forming device 132, a developing device 140, and a cleaner 161.

In the present embodiment, multiple constituent elements including the photoconductor 120, the electrostatic latent image forming device 132, the developing device 140, and the cleaner 161 are integrally combined to constitute the process cartridge 100. The process cartridge 100 is configured to be detachably attachable to an image forming apparatus body such as a copier and a printer.

The operation of an image forming apparatus equipped the process cartridge is described below.

The photoconductor 120 is driven to rotate at a predetermined circumferential speed. During rotation of the photoconductor 120, a circumferential surface of the photoconductor 120 is uniformly charged to a predetermined positive or negative potential by the electrostatic latent image forming device 132. The circumferential surface is then irradiated with light containing image information emitted from an irradiator by slit exposure or laser beam scanning exposure. Thus, electrostatic latent images are sequentially formed on the circumferential surface of the photoconductor 120. The electrostatic latent images thus formed are subsequently developed into toner images by the developing device 140. The toner images are sequentially transferred onto a transfer sheet fed from a sheet feeder to between the photoconductor 120 and the transfer device in synchronization with rotation of the photoconductor 120. The transfer sheet having the transferred image thereon is separated from the surface of the photoconductor and introduced to the fixing device so that the image is fixed thereon. The transfer sheet having the fixed image thereon is printed out the apparatus as a copy. After the image transfer, the surface of the photoconductor is cleaned by removing residual toner particles by the cleaner 161 and further neutralized to be repeatedly used for image formation.

EXAMPLES

Further understanding can be obtained by reference to certain specific examples which are provided herein for the purpose of illustration only and are not intended to be limiting.

Production Examples 1 to 6 of Master Batch MBA

Production of Master Batch MBA

Polyester resin 1 (RN-306SF manufactured by Kao Corporation, having a weight average molecular weight (Mw) of 7,700 and an acid value of 4 mgKOH/g): 70 parts by mass Vanadyl naphthalocyanine (YCR-8 manufactured by Yamamoto Chemicals, Inc., having a primary particle diameter of 60 nm): 30 parts by mass The vanadyl naphthalocyanine, used as a infrared absorbing pigment, is represented by the following structural formula (1).

[Chem.3]

Structural Formula (1)

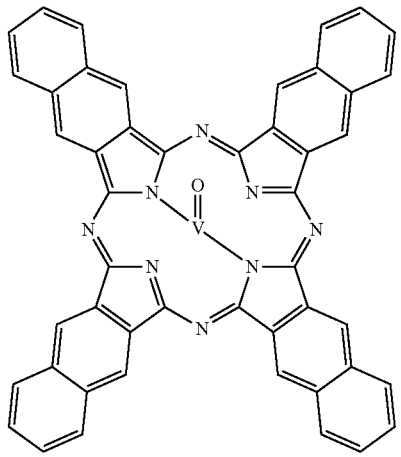

The raw materials of a master batch listed above were preliminarily mixed by a HENSCHEL MIXER (FM20B available from NIPPON COKE & ENGINEERING CO., LTD.) and melt-kneaded by an open-roll continuous kneader KNEADEX MOS-100 under the following conditions. Thus, master batches MBA-1 to MBA-6 were prepared.

Kneading Conditions

Front roller supply portion temperature: 90 degrees C.

Front roller discharge portion temperature: 70 degrees C.

Back roller supply portion temperature: 30 degrees C.

Back roller discharge portion temperature: 30 degrees C.

Front roller rotational speed: 35 rpm

Back roller rotational speed: 31 rpm

Roller gap: 250 μm

Number of times of sample pass: 10 times for MBA-1, 7 times for MBA-2, 5 times for MBA-3, 3 times for MBA-4, 2 times for MBA-5, and 1 time for MBA-6.

The average diameters of the infrared absorbing pigments in the master batches MBA-1 to MBA-6 were 60 nm, 100 nm, 120 nm, 150 nm, 200 nm, and 250 nm, respectively.

Production Example 1 of Infrared-Absorbing-Pigment-Containing Toner A

Preparation of Infrared-Absorbing-Pigment-Containing Toner A1

Polyester resin 1 (RN-306SF manufactured by Kao Corporation, having a weight average molecular weight (Mw) of 7,700 and an acid value of 4 mgKOH/g): 74 parts by mass Polyester resin 2 (RN-290SF manufactured by Kao Corporation, having a weight average molecular weight (Mw) of 87,000 and an acid value of 28 mgKOH/g): 15 parts by mass Wax dispersing agent (EXD-001 manufactured by Sanyo Chemical Industries, Ltd.): 5 parts by mass Monoester wax 1 (having a melting point (mp) of 70.5 degrees C.): 5 parts by mass Salicylic acid derivative zirconium salt A: 0.9 parts by mass Master Batch MBA-1: 1 part by mass The salicylic acid derivative zirconium salt A has the following structural formula (2).

[Chem.4]

Structural Formula (2)

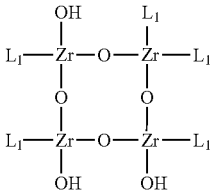

In the structural formula (2), $L_1$ represents the following structure.

[Chem.5]

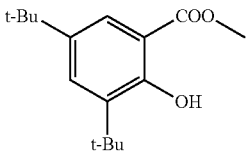

In the above formula, t-Bu represents a tertiary butyl group.

The raw materials of a toner listed above were preliminarily mixed by a HENSCHEL MIXER (FM20B available from NIPPON COKE & ENGINEERING CO., LTD.) under an intermittent condition in which a mixing operation at 1,500 rpm for 1 minute was followed by a pause for 1 minute. This operation was repeated for 5 cycles. The resultant mixture was melt-kneaded by a single-shaft kneader (BUSS CO-KNEADER from Buss AG) under the following conditions.

Kneading Conditions

Screw rotational speed: 125 rpm

Screw temperature: 40 degrees C.

Zone 1 and 2 temperature: 120 degrees C.

Zone 3 temperature: 70 degrees C.

Feed amount: 10 kg/h

The kneaded product was cooled to room temperature and pulverized into coarse particles by a ROTOPLEX to pass through a 500-μm mesh.

The coarse particles were further pulverized into fine particles having a weight average particle diameter of 6.0±0.3 μm by a COUNTER JET MILL (100AFG available from Hosokawa Micron Corporation) while appropriately adjusting the pulverization air pressure. The fine particles were classified by size using an air classifier (EJ-LABO available from MATSUBO Corporation) while appropriately adjusting the opening of the louver such that the weight average particle diameter became 6.2±0.2 μm and the ratio of weight average particle diameter to number average particle diameter became 1.20 or less. Thus, a mother toner A1 was prepared.

Subsequently, 100 parts by mass of the mother toner A1 were mixed with additives including 1.3 parts by mass of a fumed silica (ZD-30ST manufactured by Tokuyama Corporation), 1.5 parts by mass of a fumed silica (UFP-35HH manufactured by Denka Company Limited), and 1.0 part by mass of a titanium dioxide (MT-150AFM manufactured by Tayca Corporation) by a HENSCHEL MIXER, thus preparing an infrared-absorbing-pigment-containing toner A1.

Production Examples 2 to 6 of Infrared-Absorbing-Pigment-Containing Toner A

Preparation of Infrared-absorbing-pigment-containing Toners A2 to A6 Infrared-absorbing-pigment-containing toners A2 to A6 were prepared in the same manner as in Production Example 1 of Infrared-absorbing-pigment-containing Toner A except for replacing the master batch MBA-1 with the respective master batches MBA-2 to MBA-6.

Production Example 7 of Infrared-Absorbing-Pigment-Containing Toner A

Preparation of Infrared-absorbing-pigment-containing Toner A7 An infrared-absorbing-pigment-containing toner A7 was prepared in the same manner as in Production Example 1 of Infrared-absorbing-pigment-containing Toner A except for replacing the master batch MBA-1 with the following materials.

Toner Compositions

Polyester resin 1 (RN-306SF manufactured by Kao Corporation, having a weight average molecular weight (Mw) of 7,700 and an acid value of 4 mgKOH/g): 0.7 parts by mass Vanadyl naphthalocyanine (YCR-8 manufactured by Yamamoto Chemicals, Inc., having a primary particle diameter of 60 nm): 0.3 parts by mass The average diameters of the infrared absorbing pigments in the infrared-absorbing-pigment-containing layer of the infrared-absorbing-pigment-containing toners A1 to A7 were 60 nm, 100 nm, 120 nm, 150 nm, 200 nm, 250 nm, and 300 nm, respectively.

Measurement of Average Diameter of Infrared Absorbing Pigment

Printed matter in which the colored layer and the infrared-absorbing-pigment-containing layer were laminated was cut, in the vertical direction, into a thin piece having a thickness of 100 μm or less with a razor blade. The cut piece was embedded in an epoxy resin and then cut into an ultrathin section having a thickness of about 100 nm with an ultramicrotome ULTRACUT-S (manufactured by Leica). The ultrathin section was observed with a transmission electron microscope H7000 (manufactured by Hitachi, Ltd.), and a cross-sectional image of the colored layer and the infrared-absorbing-pigment-containing layer was digitally photographed at a magnification of 10,000 times. The cross-sectional image was analyzed with an image analysis software (A-ZOU KUN manufactured by Asahi Kasei Engineering Corporation) to distinguish the infrared absorbing pigment from other components by binarization, and each area was calculated. Thus, the average diameter of the infrared absorbing pigment in the infrared-absorbing-pigment-containing layer was determined.

Production Examples 1 to 4 of Master Batch MBB

Production of Master Batches MBB-1 to MBB-4

A squarylium dye master batch (OPTLION NIRX-17010 manufactured by TOYOCOLOR CO., LTD., having a pigment content ratio of 40% by mass) was used as a master batch MBB-1.

The master batch MBB-1 was kneaded by an open-roll continuous kneader KNEADEX MOS-100 under the following conditions. Thus, master batches MBB-2 to MBB-4 were prepared.

Kneading Conditions

Front roller supply portion temperature: 90 degrees C.

Front roller discharge portion temperature: 70 degrees C.

Back roller supply portion temperature: 30 degrees C.

Back roller discharge portion temperature: 30 degrees C.

Front roller rotational speed: 35 rpm

Back roller rotational speed: 31 rpm

Roller gap: 250 μm

Number of times of sample pass: 0 time for MBB-1, 1 time for MBB-2, 3 times for MBB-3, and 6 times for MBB-4.

The infrared absorbing pigment contained in the master batch MBB is a squarylium dye represented by the following formula, having diffraction peaks at Bragg angles 2θ (±0.2°) of at least 8.6°, 12.4°, 17.5°, 20.2°, 22.2° and 25.4° in the X-ray diffraction pattern by CuKα ray.

[Chem.6]

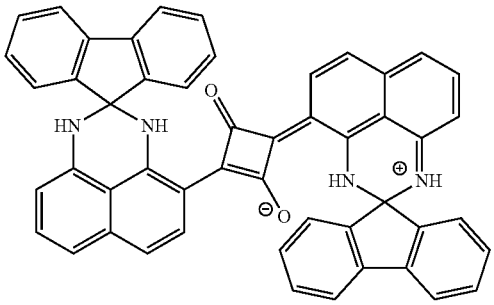

The average diameters of the infrared absorbing pigments in the master batches MBB-1 to MBB-4 were 150 nm, 120 nm, 100 nm, and 60 nm, respectively.

Production Example 1 of Infrared-Absorbing-Pigment-Containing Toner B

Preparation of Infrared-Absorbing-Pigment-Containing Toner B1

Polyester resin 1 (RN-306SF manufactured by Kao Corporation, having a weight average molecular weight (Mw) of 7,700 and an acid value of 4 mgKOH/g): 72 parts by mass Polyester resin 2 (RN-290SF manufactured by Kao Corporation, having a weight average molecular weight (Mw) of 87,000 and an acid value of 28 mgKOH/g): 15 parts by mass Wax dispersing agent (EXD-001 manufactured by Sanyo Chemical Industries, Ltd.): 5 parts by mass Monoester wax 1 (having a melting point (mp) of 70.5 degrees C.): 5 parts by mass Salicylic acid derivative zirconium salt A: 0.9 parts by mass Master Batch MBB-1: 2 parts by mass The raw materials of a toner listed above were preliminarily mixed by a HENSCHEL MIXER (FM20B available from NIPPON COKE & ENGINEERING CO., LTD.) under an intermittent condition in which a mixing operation at 1,500 rpm for 1 minute was followed by a pause for 1 minute. This operation was repeated for 5 cycles. The resultant mixture was melt-kneaded by a single-shaft kneader (BUSS CO-KNEADER from Buss AG) under the following conditions.

Melt-Kneading Conditions

Screw rotational speed: 125 rpm

Screw temperature: 40 degrees C.

Zone 1 and 2 temperature: 120 degrees C.

Zone 3 temperature: 70 degrees C.

Feed amount: 10 kg/h

The kneaded product was cooled to room temperature and pulverized into coarse particles by a ROTOPLEX to pass through a 500-μm mesh.

The coarse particles were further pulverized into fine particles having a weight average particle diameter of 6.0±0.3 μm by a COUNTER JET MILL (100AFG available from Hosokawa Micron Corporation) while appropriately adjusting the pulverization air pressure. The fine particles were classified by size using an air classifier (EJ-LABO available from MATSUBO Corporation) while appropriately adjusting the opening of the louver such that the weight average particle diameter became 6.2±0.2 μm and the ratio of weight average particle diameter to number average particle diameter became 1.20 or less. Thus, a mother toner B1 was prepared.

Subsequently, 100 parts by mass of the mother toner B1 were mixed with additives including 1.3 parts by mass of a fumed silica (ZD-30ST manufactured by Tokuyama Corporation), 1.5 parts by mass of a fumed silica (UFP-35HH manufactured by Denka Company Limited), and 1.0 part by mass of a titanium dioxide (MT-150AFM manufactured by Tayca Corporation) by a HENSCHEL MIXER, thus preparing an infrared-absorbing-pigment-containing toner B1.

Production Examples 2 to 4 of Infrared-Absorbing-Pigment-Containing Toner B

Preparation of Infrared-absorbing-pigment-containing Toners B2 to B4 Infrared-absorbing-pigment-containing toners B2 to B4 were prepared in the same manner as in Production Example 1 of Infrared-absorbing-pigment-containing Toner B except for replacing the master batch MBB-1 with the respective master batches MBB-2 to MBB-4.

The average diameters of the infrared absorbing pigments in the infrared-absorbing-pigment-containing layer of the infrared-absorbing-pigment-containing toners B1 to B4 were 150 nm, 120 nm, 100 nm, and 60 nm, respectively, as measured in same manner as those in the infrared-absorbing-pigment-containing toners A1 to A7.

Production Example 1 of Yellow Toner

Production of Yellow Toner A

Polyester resin 1 (RN-306SF manufactured by Kao Corporation, having a weight average molecular weight (Mw) of 7,700 and an acid value of 4 mgKOH/g): 68 parts by mass Polyester resin 2 (RN-290SF manufactured by Kao Corporation, having a weight average molecular weight (Mw) of 87,000 and an acid value of 28 mgKOH/g): 15 parts by mass Wax dispersing agent (EXD-001 manufactured by Sanyo Chemical Industries, Ltd.): 5 parts by mass Monoester wax 1 (having a melting point (mp) of 70.5 degrees C.): 5 parts by mass Salicylic acid derivative zirconium salt A: 0.9 parts by mass Yellow master batch (N-DYM RC 5470 YELLOW manufactured by Dainichiseika Color & Chemicals Mfg. Co., Ltd.): 14 parts by mass The raw materials of a toner listed above were preliminarily mixed by a HENSCHEL MIXER (FM20B available from NIPPON COKE & ENGINEERING CO., LTD.) under an intermittent condition in which a mixing operation at 1,500 rpm for 1 minute was followed by a pause for 1 minute. This operation was repeated for 5 cycles. The resultant mixture was melt-kneaded by a single-shaft kneader (BUSS CO-KNEADER from Buss AG) under the following conditions.

Melt-Kneading Conditions

Screw rotational speed: 125 rpm

Screw temperature: 40 degrees C.

Zone 1 and 2 temperature: 120 degrees C.

Zone 3 temperature: 70 degrees C.

Feed amount: 10 kg/h

The kneaded product was cooled to room temperature and pulverized into coarse particles by a ROTOPLEX to pass through a 500-μm mesh.

The coarse particles were further pulverized into fine particles having a weight average particle diameter of 6.0±0.3 μm by a COUNTER JET MILL (100AFG available from Hosokawa Micron Corporation) while appropriately adjusting the pulverization air pressure. The fine particles were classified by size using an air classifier (EJ-LABO available from MATSUBO Corporation) while appropriately adjusting the opening of the louver such that the weight average particle diameter became 6.2±0.2 μm and the ratio of weight average particle diameter to number average particle diameter became 1.20 or less. Thus, a mother toner Y was prepared.

Subsequently, 100 parts by mass of the mother toner Y were mixed with additives including 1.3 parts by mass of a fumed silica (ZD-30ST manufactured by Tokuyama Corporation), 1.5 parts by mass of a fumed silica (UFP-35HH manufactured by Denka Company Limited), and 1.0 part by mass of a titanium dioxide (MT-150AFM manufactured by Tayca Corporation) by a HENSCHEL MIXER, thus preparing a yellow toner A.

Production Example 1 of Magenta Toner

Production of Magenta Toner A

Polyester resin 1 (RN-306SF manufactured by Kao Corporation, having a weight average molecular weight (Mw) of 7,700 and an acid value of 4 mgKOH/g): 67 parts by mass Polyester resin 2 (RN-290SF manufactured by Kao Corporation, having a weight average molecular weight (Mw) of 87,000 and an acid value of 28 mgKOH/g): 15 parts by mass Wax dispersing agent (EXD-001 manufactured by Sanyo Chemical Industries, Ltd.): 5 parts by mass Monoester wax 1 (having a melting point (mp) of 70.5 degrees C.): 5 parts by mass Salicylic acid derivative zirconium salt A: 0.9 parts by mass Magenta master batch (N-DYM RC 5140 RED manufactured by Dainichiseika Color & Chemicals Mfg. Co., Ltd.): 16 parts by mass A magenta toner A was produced under the same conditions as in Production Example 1 of Yellow Toner using the above-listed raw materials of a toner.

Production Example 1 of Cyan Toner Production of Cyan Toner A

Polyester resin 1 (RN-306SF manufactured by Kao Corporation, having a weight average molecular weight (Mw) of 7,700 and an acid value of 4 mgKOH/g): 70 parts by mass Polyester resin 2 (RN-290SF manufactured by Kao Corporation, having a weight average molecular weight (Mw) of 87,000 and an acid value of 28 mgKOH/g): 15 parts by mass Wax dispersing agent (EXD-001 manufactured by Sanyo Chemical Industries, Ltd.): 5 parts by mass Monoester wax 1 (having a melting point (mp) of 70.5 degrees C.): 5 parts by mass Salicylic acid derivative zirconium salt A: 0.9 parts by mass Cyan master batch (N-DYM RC 5620 BLUE manufactured by Dainichiseika Color & Chemicals Mfg. Co., Ltd.): 10 parts by mass A cyan toner A was produced under the same conditions as in Production Example 1 of Yellow Toner using the above-listed raw materials of a toner.

Production Example 1 of Black Master Batch

Production of Black Master Batch

Polyester resin 1 (RN-306SF manufactured by Kao Corporation, having a weight average molecular weight (Mw) of 7,700 and an acid value of 4 mgKOH/g): 50 parts by mass Perylene black (FK-4280 manufactured by BASF Colors & Effects Japan Ltd., having a primary particle diameter of 80 nm): 40 parts by mass Pigment Yellow 185 (D1155 manufactured by BASF Colors & Effects Japan Ltd., having a primary particle diameter of 80 nm): 10 parts by mass The raw materials of a master batch listed above were preliminarily mixed by a HENSCHEL MIXER (FM20B available from NIPPON COKE & ENGINEERING CO., LTD.) and melt-kneaded by an open-roll continuous kneader KNEADEX MOS100 under the following conditions. Thus, a black master batch MBP was prepared.

Kneading Conditions

Front roller supply portion temperature: 90 degrees C.

Front roller discharge portion temperature: 70 degrees C.

Back roller supply portion temperature: 30 degrees C.

Back roller discharge portion temperature: 30 degrees C.

Front roller rotational speed: 35 rpm

Back roller rotational speed: 31 rpm

Roller gap: 250 μm

Number of times of sample pass: 5 times

Production Example 1 of Black Toner

Production of Black Toner A

Polyester resin 1 (RN-306SF manufactured by Kao Corporation, having a weight average molecular weight (Mw) of 7,700 and an acid value of 4 mgKOH/g): 66 parts by mass Polyester resin 2 (RN-290SF manufactured by Kao Corporation, having a weight average molecular weight (Mw) of 87,000 and an acid value of 28 mgKOH/g): 15 parts by mass Wax dispersing agent (EXD-001 manufactured by Sanyo Chemical Industries, Ltd.): 5 parts by mass Monoester wax 1 (having a melting point (mp) of 70.5 degrees C.): 5 parts by mass Salicylic acid derivative zirconium salt A: 0.9 parts by mass Black master batch MBP: 18 parts by mass A black toner A was produced under the same conditions as in Production Example 1 of Yellow Toner using the above-listed raw materials of a toner.

Production of Two-Component Developer

Preparation of Carrier

Silicone resin (Organo straight silicone): 100 parts by mass

Toluene: 100 parts by mass

γ-(2-Aminoethyl)aminopropyl trimethoxysilane: 5 parts by mass

Carbon black: 10 parts by mass

The above materials were dispersed by a homomixer for 20 minutes to prepare a coating layer forming liquid. Manganese (Mn) ferrite particles having a weight average particle diameter of 35 μm as core materials were coated with the coating layer forming liquid using a fluidized bed coating device while controlling the temperature inside the fluidized bed to 70 degrees C., followed by drying, so that the coating layer was formed on the surface of the core materials with an average film thickness of 0.20 m. The core materials having the coating layer were burnt in an electric furnace at 180 degrees C. for 2 hours. Thus, a carrier was prepared.

Preparation of Two-Component Developer

Each of the above-prepared infrared-absorbing-pigment-containing toners A1 to A7, infrared-absorbing-pigment-containing toners B1 to B4, yellow toner A, magenta toner A, cyan toner A, and black toner A was uniformly mixed with the carrier by a TURBULA MIXER (available from Willy A. Bachofen (WAB)) at a revolution of 48 rpm for 5 minutes to be charged. Thus, invisible developers A1 to A7, invisible developers B1 to B4, a yellow developer A, a magenta developer A, a cyan developer A, and a black developer A were prepared.

The mixing ratio of the toner to the carrier was 5% by mass, which was equal to the initial toner concentration in the developer in the test machine.

Examples 1 to 4 and Comparative Examples 1 to 3

A digital full-color multifunction peripheral (IMAGIO NEO C600 manufactured by Ricoh Co., Ltd., hereinafter simply "NEO C600") was modified to accommodate a toner set containing an infrared-absorbing-pigment-containing toner and a color toner, by replacing the accommodated black developer, yellow developer, magenta developer, and cyan developer with each of the invisible developers A1 and A7, the yellow developer A, the magenta developer A, and the cyan developer A, respectively.

The absorbance of each of yellow, magenta, and cyan toners contained in the yellow, magenta, and cyan developers, respectively, at a wavelength of from 750 to 900 nm was 0.01 or less when measured as follows.

Measurement of Absorbance

A solid patch having a toner deposition amount of 0.5 mg/cm$^2$ was output on an OHP film (TYPE PPC-FC manufactured by Ricoh Co., Ltd.) by the NEO C600. The solid patch and a blank OHP film with no image were subjected to a measurement by a spectrophotometer (V-660DS manufactured by JASCO Corporation) to determine a spectral transmittance T of each color toner within a wavelength range of from 750 to 900 nm. An absorbance A was calculated based on the above-obtained spectral transmittance T according to the following equation.

$$\text{Absorbance } A = -\log T$$

Adjustment of Toner Deposition Amount

First, a solid patch of 5 cm×5 cm of each color toner was output on a paper sheet (TYPE 6000 (70 W) manufactured by Ricoh Co., Ltd.).

The solid patch was cut out with scissors into a cutout piece. The mass of the cutout piece was measured with a precision balance. After the toner in the solid patch portion (unfixed image portion) was blown off with an air gun, the mass of the cutout piece was measured again. The toner deposition amount was calculated from the mass of the cutout piece before and after the toner had been blown off by the air gun according to the following formula.

$$\text{Toner Deposition Amount (mg/cm}^2\text{)} = ((\text{Mass of Cutout Piece with Solid Patch}) - (\text{Mass of Cutout Piece after Blowing of Toner}))/25$$

The developing conditions were adjusted so that the deposition amount of each color toner became 0.40 mg/cm$^2$. Further, developing conditions which make the deposition amount of the infrared-absorbing-pigment-containing toners A1 to A7 to be 0.30 mg/cm$^2$, 0.35 mg/cm$^2$, 0.40 mg/cm$^2$, 0.45 mg/cm$^2$, 0.50 mg/cm$^2$, and 0.55 mg/cm$^2$ were confirmed.

Evaluations

Figure 13A:
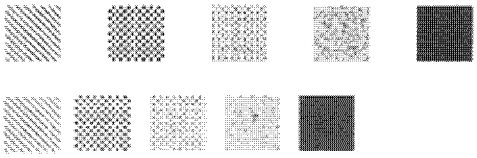
FIG. 13A is a diagram illustrating printed matter including only a color toner image, output in Examples.

On the paper sheet (TYPE 6000 (70 W) manufactured by Ricoh Co., Ltd.) as a recording medium, QR codes (registered trademark) were printed with each infrared-absorbing-pigment-containing toner, and patterns illustrated in FIG. 13A were further printed thereon. Thus, printed matter containing the QR codes concealed by the patterns was prepared as illustrated in FIG. 13B.

Further, printed matters having a deposition amount of the infrared-absorbing-pigment-containing toners A1 to A7 of 0.30 mg/cm$^2$, 0.35 mg/cm$^2$, 0.40 mg/cm$^2$, 0.45 mg/cm$^2$, 0.50 mg/cm$^2$, and 0.55 mg/cm$^2$, respectively, were prepared.

Figure 14:
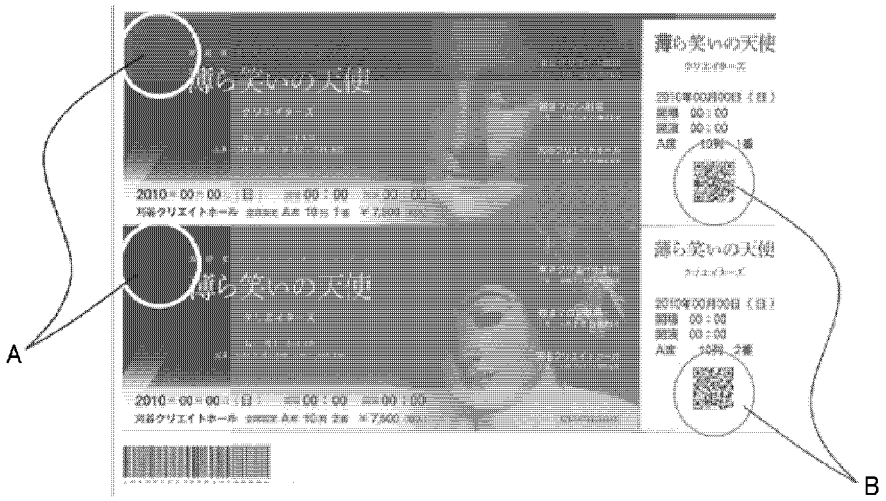
FIG. 14 is a diagram illustrating printed matter in which an infrared-absorbing-pigment-containing toner image and a color toner image are superimposed, output in Examples.

In addition, an image illustrated in FIG. 14 was printed that contains an image portion A and an image portion B. The image portion A is an entirely colored portion in which a QR code (registered trademark) is printed with the infrared-absorbing-pigment-containing toner. The image portion B contains a QR code printed with the color toner and another QR code (registered trademark) printed with the infrared-absorbing-pigment-containing toner below the QR code printed with the color toner, each containing different information.

Figure 13B:
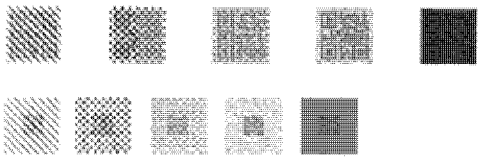
FIG. 13B is a diagram illustrating printed matter in which an infrared-absorbing-pigment-containing toner image and a color toner image are superimposed, output in Examples.

Visibility of the infrared-absorbing-pigment-containing toner image and readability of the QR code (registered trademark) outputted with the infrared-absorbing-pigment-containing toner were evaluated from the printed matters illustrated in FIGS. 13A, 13B, and 14. The results are shown in Table 3. It is to be noted that infrared-absorbing-pigment-containing toner images that are inherently invisible are visually drawn in FIG. 13A for the purpose of explanation.

The black color was expressed by stacking yellow, magenta, and cyan toners.

Evaluation of Machine Readability

Whether the QR code (registered trademark) of the printed matter was readable by a handy terminal BHT-845QW (manufactured by DENSO WAVE INCORPORATED) was evaluated under the following conditions.

Printed matter 1 including the superimposed image illustrated in FIGS. 13A and 13B and printed matter 2 including the image illustrated in FIG. 14 were each printed on 10 sheets. Machine readability was ranked into A to C as follows. A: 100% of the QR codes on the printed matter was readable when the distance between the printed matter and the handy terminal was approximately 30 cm. B: 100% of the QR codes on the printed matter was readable when the distance between the printed matter and the handy terminal was reduced. C: At least one of the QR codes (registered trademark) was unreadable. The results are shown in Table 1.

TABLE 1

| | | Comparative Example 1 Toner A1 | Comparative Example 2 Toner A2 | Example 1 Toner A3 | Example 2 Toner A4 | Example 3 Toner A5 | Example 4 Toner A6 | Comparative Example 3 Toner A7 |
|---|---|---|---|---|---|---|---|---|
| | | Average Diameter of Infrared Absorbing Pigment (μm) | | | | | | |
| | | 60 nm | 100 nm | 120 nm | 150 nm | 200 nm | 250 nm | 300 nm |
| Deposition Amount of Infrared-absorbing-pigment-containing Toner ($mg/cm^2$) | 0.35 | C | C | A | A | B | B | C |
| | 0.4 | C | C | A | A | A | B | C |
| | 0.45 | B | B | A | A | A | A | C |
| | 0.5 | A | A | A | A | A | A | A |
| | 0.55 | A | A | A | A | A | A | A |
| Machine Readability Judgment | | C | C | A | A | A | B | C |

Evaluation of Visibility

Visibility was ranked by the number of persons, among 20 randomly extracted monitors, who were able to visually recognize the infrared-absorbing-pigment-containing layer (invisible image) underlying the colored layer on the recording medium of the printed matter illustrated in FIG. 14. When the number of persons was 2 or less, visibility was ranked A. When the number of persons was from 3 to 5, visibility was ranked B. When the number of persons was 6 or more, visibility was ranked C. The results are shown in Table 2.

TABLE 2

| | | Comparative Example 1 Toner A1 | Comparative Example 2 Toner A2 | Example 1 Toner A3 | Example 2 Toner A4 | Example 3 Toner A5 | Example 4 Toner A6 | Comparative Example 3 Toner A7 |
|---|---|---|---|---|---|---|---|---|
| | | Average Diameter of Infrared Absorbing Pigment (μm) | | | | | | |
| | | 60 nm | 100 nm | 120 nm | 150 nm | 200 nm | 250 nm | 300 nm |
| Deposition Amount of Infrared-absorbing pigment-containing Toner ($mg/cm^2$) | 0.3 | A | A | A | A | A | A | A |
| | 0.35 | A | A | A | A | A | A | A |
| | 0.4 | C | C | A | A | A | A | A |
| | 0.45 | C | C | B | A | A | A | A |
| Invisibility Judgement | | C | C | A | A | A | A | A |

Comprehensive Judgment

Based on the above evaluation results for machine readability and visibility, comprehensive judgment was performed as follows. Good: Both evaluation results are A ranks. Acceptable: At least one evaluation result is B rank. Unacceptable: At least one evaluation result is C rank. The results are shown in Table 3.

TABLE 3

| | Comparative Example 1 Toner A1 | Comparative Example 2 Toner A2 | Example 1 Toner A3 | Example 2 Toner A4 | Example 3 Toner A5 | Example 4 Toner A6 | Comparative Example 3 Toner A7 |
|---|---|---|---|---|---|---|---|
| Machine Readability Judgment | C | C | A | A | A | B | C |
| Invisibility Judgement | C | C | B | A | A | A | A |
| Comprehensive Judgment | Unacceptable | Unacceptable | Acceptable | Good | Good | Acceptable | Unacceptable |

Examples 5 and 6 and Comparative Examples 4 and 5

A production printer (RICOH PRO C7110 manufactured by Ricoh Co., Ltd.) accommodating five color toners, i.e., yellow toner, magenta toner, cyan toner, black toner, and special-use toner, was used. The black toner, yellow toner, magenta toner, cyan toner, and the special-use toner accommodated in the printer were replaced with each of the infrared-absorbing-pigment-containing toners B1 to B4, the yellow toner A, the magenta toner A, the cyan toner A, and black toner A, respectively.

The absorbance of each of the color toners (black, yellow, magenta, and cyan toners) at a wavelength of 750 nm or more was less than 0.01.

As a paper sheet, COATED GLOSSY PAPER (135 g/m$^2$ manufactured by Mondi Group) was used. A solid patch of 5 cm×5 cm was output on the paper sheet using each color toner, and the deposition amount was measured in the same manner as in the above-described procedure.

Further, developing conditions which make the deposition amount of the infrared-absorbing-pigment-containing toners B1 to B4 to be 0.30 mg/cm$^2$, 0.35 mg/cm$^2$, 0.40 mg/cm$^2$, 0.45 mg/cm$^2$, 0.50 mg/cm$^2$, and 0.55 mg/cm$^2$ were confirmed.

Evaluations

On the paper sheet COATED GLOSSY PAPER (135 g/m$^2$ manufactured by Mondi Group) as a recording medium, QR codes (registered trademark) were printed with each infrared-absorbing-pigment-containing toner, and patterns illustrated in FIG. 13A were further printed thereon. Thus, printed matter containing the QR codes concealed by the patterns was prepared as illustrated in FIG. 13B.

Further, printed matters having a deposition amount of the infrared-absorbing-pigment-containing toners B1 to B4 of 0.30 mg/cm$^2$, 0.35 mg/cm$^2$, 0.40 mg/cm$^2$, 0.45 mg/cm$^2$, 0.50 mg/cm$^2$, and 0.55 mg/cm$^2$, respectively, were prepared.

In addition, an image illustrated in FIG. 14 was printed that contains an image portion A and an image portion B. The image portion A is an entirely colored portion in which a QR code (registered trademark) is printed with the infrared-absorbing-pigment-containing toner. The image portion B contains a QR code printed with the color toner and another QR code (registered trademark) printed with the infrared-absorbing-pigment-containing toner below the QR code printed with the color toner, each containing different information.

Visibility of the infrared-absorbing-pigment-containing toner image and readability of the QR code (registered trademark) outputted with the infrared-absorbing-pigment-containing toner were evaluated from the printed matters illustrated in FIGS. 13A, 13B, and 14. The results are shown in Table 6. It is to be noted that infrared-absorbing-pigment-containing toner images that are inherently invisible are visually drawn in FIG. 13A for the purpose of explanation. Here, the black color is expressed by using the black toner A.

Evaluation of Machine Readability

In the same manner as described above, whether the QR code (registered trademark) of the printed matter was readable by a handy terminal BHT-845QW (manufactured by DENSO WAVE INCORPORATED) was evaluated under the following conditions.

Printed matter 1 including the superimposed image illustrated in FIGS. 13A and 13B and printed matter 2 including the image illustrated in FIG. 14 were each printed on 10 sheets. Machine readability was ranked into A to C as follows. A: 100% of the QR codes on the printed matter was readable when the distance between the printed matter and the handy terminal was approximately 30 cm. B: 100% of the QR codes on the printed matter was readable when the distance between the printed matter and the handy terminal was reduced. C: At least one of the QR codes (registered trademark) was unreadable. The results are shown in Table 4.

TABLE 4

| | | Comparative Example 4 Toner B4 | Comparative Example 5 Toner B3 | Example 5 Toner B2 | Example 6 Toner B1 |
|---|---|---|---|---|---|
| | | Average Diameter of Infrared Absorbing Pigment (μm) | | | |
| | | 60 nm | 100 nm | 120 nm | 150 nm |
| Deposition Amount of Infrared-absorbing-pigment-containing Toner (mg/cm$^2$) | 0.35 | C | C | A | A |
| | 0.4 | C | C | A | A |
| | 0.45 | B | B | A | A |
| | 0.5 | A | A | A | A |
| | 0.55 | A | A | A | A |
| Machine Readability Judgment | | C | C | A | A |

Evaluation of Visibility

In the same manner as described above, visibility was ranked by the number of persons, among 20 randomly extracted monitors, who were able to visually recognize the infrared-absorbing-pigment-containing layer (invisible image) underlying the colored layer on the recording medium of the printed matter illustrated in FIG. 14. When the number of persons was 2 or less, visibility was ranked A.

When the number of persons was from 3 to 5, visibility was ranked B. When the number of persons was 6 or more, visibility was ranked C. The results are shown in Table 5.

TABLE 5

| | | Comparative Example 4 Toner B4 | Comparative Example 5 Toner B3 | Example 5 Toner B2 | Example 6 Toner B1 |
|---|---|---|---|---|---|
| | | Average Diameter of Infrared Absorbing Pigment (μm) | | | |
| | | 60 nm | 100 nm | 120 nm | 150 nm |
| Deposition Amount of Infrared-absorbing-pigment-containing Toner ($mg/cm^2$) | 0.3 | A | A | A | A |
| | 0.35 | A | A | A | A |
| | 0.4 | A | A | A | A |
| | 0.45 | B | C | A | A |
| Invisibility Judgement | | B | C | A | A |

Comprehensive Judgment

Based on the above evaluation results for machine readability and visibility, comprehensive judgment was performed according to the following criteria. The results are shown in Table 6.

Evaluation Criteria

Good: Both evaluation results are A ranks.

Acceptable: At least one evaluation result is B rank.

Unacceptable: At least one evaluation result is C rank.

TABLE 6

| | Comparative Example 4 Toner B4 | Comparative Example 5 Toner B3 | Example 5 Toner B2 | Example 6 Toner B1 |
|---|---|---|---|---|
| Machine Readability Judgment | C | C | A | A |
| Invisibility Judgement | B | C | A | A |
| Comprehensive Judgment | Unacceptable | Unacceptable | Good | Good |

The printed matter according to an embodiment of the present invention comprises a recording medium, a colored layer containing a colorant and overlying the recording medium, and an infrared-absorbing-pigment-containing layer overlying the recording medium and underlying the colored layer. Making use of the characteristics of the infrared absorbing pigment, the used amount of the infrared absorbing pigment has been reduced and stable machine readability has been achieved while ensuring invisibility of the infrared-absorbing-pigment-containing layer.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

This patent application is based on and claims priority to Japanese Patent Application No. 2018-223010, filed on Nov. 29, 2018, in the Japan Patent Office, the entire disclosure of which is hereby incorporated by reference herein.

REFERENCE SIGNS LIST

200 Printed matter
201 Recording medium
202Y Colored layer containing a yellow colorant
202M Colored layer containing a magenta colorant
202C Colored layer containing a cyan colorant
203 Infrared-absorbing-pigment-containing layer

The invention claimed is:

1. Printed matter, comprising:
a recording medium;
a colored layer overlying the recording medium; the colored layer containing a colorant; and
an infrared-absorbing-pigment-containing layer overlying the recording medium and underlying the colored layer, the infrared-absorbing-pigment-containing layer containing an infrared absorbing pigment having an average diameter of from 120 to 250 nm in the infrared-absorbing-pigment-containing layer,
wherein the infrared absorbing pigment comprises vanadium naphthalocyanine, and
wherein the printed matter is produced by an electrophotographic method.

2. The printed matter according to claim 1,
wherein the colorant comprises a yellow colorant, a magenta colorant, and a cyan colorant, and
wherein the colorant has an absorbance of 0.01 or less at a wavelength of from 750 to 900 nm.

3. The printed matter according to claim 1,
wherein the colorant comprises a yellow colorant, a magenta colorant, a cyan colorant, and a black colorant, and
wherein the colorant has an absorbance of 0.01 or less at a wavelength of from 750 to 900 nm.

4. The printed matter according to claim 1, wherein the infrared-absorbing-pigment-containing layer is a variable printing layer.

5. An infrared-absorbing-pigment-containing toner comprising:
a binder resin; and
an infrared absorbing pigment having an average diameter of from 120 to 250 nm in the infrared-absorbing-pigment-containing toner,
wherein the infrared absorbing pigment comprises vanadium naphthalocyanine.

6. A toner set, comprising:
a color toner comprising a binder resin and a colorant; and
the infrared-absorbing-pigment-containing toner according to claim 5.

7. The toner set according to claim 6, wherein the color toner comprises at least one of yellow toner, magenta toner, cyan toner, and black toner.

8. An image forming method, comprising:
forming an electrostatic latent image on an electrostatic latent image bearer;
developing the electrostatic latent image with the toner set according to claim 6 to form a toner image comprising an infrared-absorbing-pigment-containing toner image and a color toner image;
transferring the toner image onto a recording medium; and
fixing the toner image on the recording medium.

9. The image forming method according to claim 8, further comprising:
forming a colored layer overlying the recording medium, the colored layer comprising the color toner image; and forming an infrared-absorbing-pigment-containing layer overlying the recording medium and underlying the colored layer, the infrared-absorbing-pigment-containing layer comprising the infrared-absorbing-pigment-containing toner image.

10. An image forming apparatus, comprising:

an electrostatic latent image bearer;

an electrostatic latent image forming device configured to form an electrostatic latent image on the electrostatic latent image bearer;

a developing device containing the toner set according to claim 6, the developing device configured to develop the electrostatic latent image with the toner set to form a toner image comprising an infrared-absorbing-pigment-containing toner image and a color toner image;

a transfer device configured to transfer the toner image onto a recording medium; and a fixing device configured to fix the toner image on the recording medium.

11. The image forming apparatus according to claim 10, wherein the image forming apparatus is configured to:

form a colored layer overlying the recording medium, the colored layer comprising the color toner image; and form an infrared-absorbing-pigment-containing layer overlying the recording medium and underlying the colored layer, the infrared-absorbing-pigment-containing layer comprising the infrared-absorbing-piment-containing toner image.

12. The printed matter according to claim 1, wherein the colored layer comprises 3% to 12% by mass of the colorant.

13. The printed matter according to claim 1, wherein the colorant has an average diameter of 120 nm or less.

14. The printed matter according to claim 1, wherein the proportion of infrared absorbing pigment in the infrared-absorbing-pigment-containing layer is from 0.3% to 1.0% by mass.

15. The infrared-absorbing-pigment-containing toner according to claim 5, wherein the hinder resin comprises a polyester resin.

* * * * *